US011378319B2

(12) United States Patent
Sigl et al.

(10) Patent No.: US 11,378,319 B2
(45) Date of Patent: Jul. 5, 2022

(54) ICE MAKER WITH SPECIFIC COUPLING OF A DRIVING UNIT WITH A STORAGE CONTAINER, AND HOUSEHOLD COOLING APPLIANCE

(71) Applicant: BSH HAUSGERAETE GMBH, Munich (DE)

(72) Inventors: Mathias Sigl, Herbrechtingen (DE); Robert Stahl, Herbrechtingen (DE); Josef Bauriedl, Neunburg (DE)

(73) Assignee: BSH Hausgeraete GmbH, Munich (DE)

( * ) Notice: Subject to any disclaimer, the term of this patent is extended or adjusted under 35 U.S.C. 154(b) by 278 days.

(21) Appl. No.: 16/733,287

(22) Filed: Jan. 3, 2020

(65) Prior Publication Data

US 2021/0207862 A1 Jul. 8, 2021

(51) Int. Cl.

| | |
|---|---|
| ***F25C 1/00*** | (2006.01) |
| ***F25D 13/02*** | (2006.01) |
| ***F25C 5/182*** | (2018.01) |

(52) U.S. Cl.

CPC ..... *F25C 1/00* (2013.01); *F25C 5/182* (2013.01); *F25D 13/02* (2013.01); *F25C 2400/00* (2013.01); *F25D 2303/0832* (2013.01)

(58) Field of Classification Search

CPC .... F25C 1/00; F25C 5/24; F25C 5/182; F25C 2400/00; F25C 2400/10; F25D 13/02; F25D 17/065; F25D 19/003; F25D 19/02; F25D 2317/061; F25D 2303/0832

See application file for complete search history.

(56) References Cited

U.S. PATENT DOCUMENTS

| | | | | |
|---|---|---|---|---|
| 7,594,413 | B2 | 9/2009 | Martin et al. | |
| 9,107,560 | B2 | 8/2015 | Bauriedl | |
| 2015/0135760 | A1* | 5/2015 | Jeong | F25C 5/182 62/344 |
| 2016/0201968 | A1* | 7/2016 | Jeong | F25D 11/02 62/344 |

* cited by examiner

*Primary Examiner* — Joseph F Trpisovsky

(74) *Attorney, Agent, or Firm* — Laurence A. Greenberg; Werner H. Stemer; Ralph E. Locher

(57) ABSTRACT

An ice maker for mounting into a household cooling appliance, comprising: a storage container for ice comprising a rear wall and an opening, which is accessible from the top, a coupling extension, which is arranged on the rear wall and extends towards the rear, a driving unit comprising a drive housing and a closing aid arranged in the drive housing for locking of the storage container in a closed end position, wherein the drive housing comprises a front wall, at which an insertion opening of the closing aid is arranged so that upon inserting of the coupling extension into the insertion opening the coupling extension couples with the closing aid and by the closing aid viewed in the depth direction of the ice maker said coupling extension is pulled into the locking position towards the rear.

11 Claims, 14 Drawing Sheets

ICE MAKER WITH SPECIFIC COUPLING OF A DRIVING UNIT WITH A STORAGE CONTAINER, AND HOUSEHOLD COOLING APPLIANCE

BACKGROUND OF THE INVENTION

Field of the Invention

One aspect of the invention relates to an ice maker for a household cooling appliance. A further aspect of the invention relates to a household cooling appliance with an ice maker. A further aspect of the invention relates to a method for self-locking of an ice maker.

U.S. Pat. No. 9,107,560 B2 discloses a locking unit comprising a translationally and rotationally moved latch.

U.S. Pat. No. 7,594,413 B2 discloses a locking system for an ice maker with a latch mounted at a front cover of an ice compartment.

BRIEF SUMMARY OF THE INVENTION

It is an object of the present invention to provide an ice maker, in which mechanical coupling between a driving unit and a storage container is improved. A further object is to provide a household cooling appliance with improved coupling concept of an ice maker. A further object of the invention is to provide a method for an improved coupling of a driving unit and a storage container of an ice maker.

With the above and other objects in view there is provided, in accordance with the invention, an ice maker for mounting into a household cooling appliance, comprising:

a storage container for ice having a rear wall and an opening that is accessible from above;

a coupling extension arranged on the rear wall and extending towards a rear;

a driving unit having a drive housing and a closing aid arranged in the drive housing for locking the storage container in a closed end position;

the drive housing having a front wall at which an insertion opening of the closing aid is arranged so that, upon an insertion of the coupling extension into the insertion opening, the coupling extension couples with the closing aid and the coupling extension is pulled by the closing aid into a locking position towards the rear viewed in a depth direction of the ice maker.

That is, the objects of the invention are solved by the ice maker and a household cooling appliance, as well as by a method, as claimed.

An aspect relates to an ice maker for mounting into a household cooling appliance, comprising:

a storage container for ice comprising a rear wall and an opening, which is accessible from the top, a coupling extension, which is arranged on the rear wall and extends towards the rear, a driving unit comprising a drive housing and a closing aid arranged in the drive housing for locking of the storage container in a closed end position, wherein the drive housing comprises a front wall, at which an insertion opening of the closing aid is arranged so that upon inserting of the coupling extension into the insertion opening the coupling extension couples with the closing aid and by the closing aid viewed in the depth direction of the ice maker said coupling extension is pulled into the locking position towards the rear.

With the above and other objects in view there is also provided, in accordance with the invention, a household cooling appliance comprising an ice maker, wherein the ice maker comprises:

a storage container for ice comprising a rear wall and an opening, which is accessible from the top, a coupling extension, which is arranged on the rear wall and extends towards the rear, a driving unit comprising a drive housing and a closing aid arranged in the drive housing for locking of the storage container, wherein the drive housing comprises a front wall, at which an insertion opening of the closing aid is arranged so that upon inserting the coupling extension into the insertion opening the coupling extension couples with the closing aid and by the closing aid viewed in the depth direction of the ice maker said coupling extension is pulled into the locking position towards the rear.

Finally, with the above and other objects in view there is also provided, in accordance with the invention, a method for locking of an ice maker comprising the following steps:

providing a driving unit of the icemaker;

providing a storage container of the ice maker;

inserting the storage container into an outer housing of the ice maker in the depth direction of the ice maker;

inserting a coupling extension, which is arranged on a rear wall of the storage container, into an insertion opening of a closing aid of the ice maker, wherein the insertion opening is formed in a front wall of the drive housing of the driving unit and the closing aid is arranged in the drive housing of the driving unit;

coupling the coupling extension with a gripper of the closing aid upon further inserting in the depth direction;

rotating of the gripper from the basic position by further inserting of the storage container in the depth direction;

releasing of a loaded energy storage after a defined rotating movement of the gripper and further translatory moving of the gripper into a snapped-over position by unloading of the energy storage and thereby pulling of the storage container in the depth direction up to the driving unit so that a front wall of the outer housing of the ice maker.

According to another aspect of the present disclosure, the ice maker comprising an outer housing with a front wall, wherein the front wall is arranged at the front of the storage container and this front wall upon pulling towards the rear of the storage container is capable of being pulled along towards the rear.

According to another aspect of the present disclosure, the ice maker comprising an outer housing with a front frame, wherein in the locking position the front wall is pressed to the front frame.

According to another aspect of the present disclosure, wherein on a rear side of the front wall a sealing is arranged.

According to another aspect of the present disclosure, wherein the driving unit is arranged at the rear of the ice maker viewed in the depth direction of the ice maker.

According to another aspect of the present disclosure, wherein the closing aid comprises a gripper and an loaded energy storage for snapping the gripper over from a basic position into a snapped-over position, wherein upon inserting the coupling extension into the insertion opening the gripper is rotated and thereby the loaded energy storage is released so that the gripper is translatory movable into the snapped-over position by the loaded energy storage and the coupling extension coupled with the gripper is pulled towards the rear and the locking position of the storage container is set.

According to another aspect of the present disclosure, wherein the driving unit comprises:

a drive motor, which is arranged in the drive housing, at least one drive motor arranged in a chamber of the drive housing, a first receiving duct for accommodating a first fastening part extending completely through the drive housing, wherein the drive housing can be fastened by the first fastening part to an inner liner wall of the refrigeration compartment, wherein said first receiving duct extending across the entire depth of the drive housing and is open at a front end and is open at a rear end, and a second receiving duct for a second fastening part extending completely through the drive housing, wherein the drive housing can be fastened by the second fastening part to the same inner liner wall of the refrigeration compartment, wherein said second receiving duct extends across the entire depth of the drive housing and is open at a front end and is open at a rear end.

According to another aspect of the present disclosure, wherein the drive housing of the driving unit comprises a front wall and in the drive housing an air duct is formed, wherein an air duct outlet of the air duct is arranged on the front wall.

According to another aspect of the present disclosure, wherein the drive housing comprises a front wall, and the driving unit comprises a coupling entry for mechanical coupling of a storage container of the ice compartment with the driving unit, wherein the coupling entry is arranged at said front wall of the drive housing.

According to another aspect of the present disclosure, wherein the drive housing comprises a front wall, and in the drive housing a drive motor is arranged, wherein at the front wall a passage is formed, through which a shaft of the drive motor extends or through which a coupling part of a conveyer of the ice compartment can extend in order to couple with the drive motor in the interior of the drive housing.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the dependencies of the claims.

and

Figure 2:
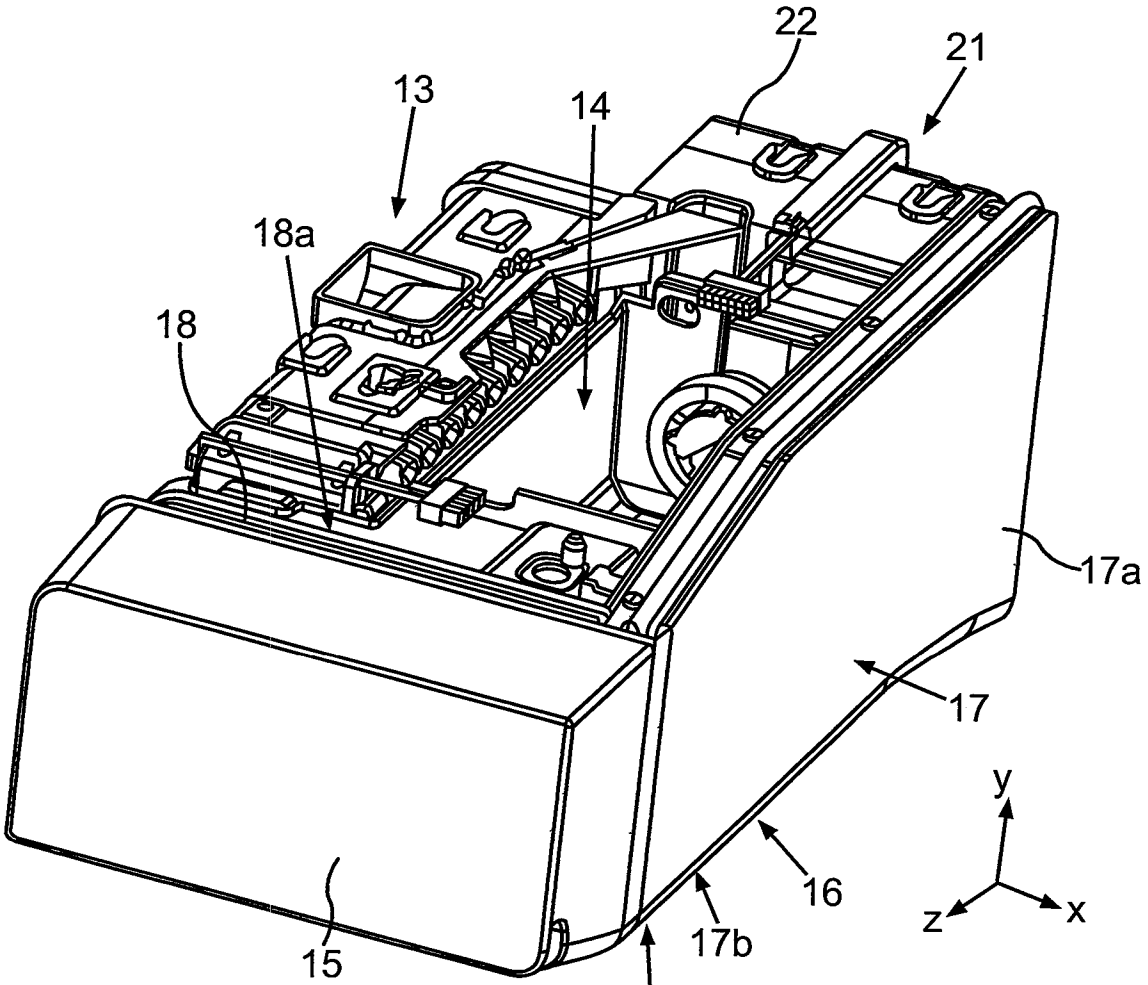
FIG. 2 is a perspective view of an embodiment of an ice maker according to the invention.
Figure 12A:
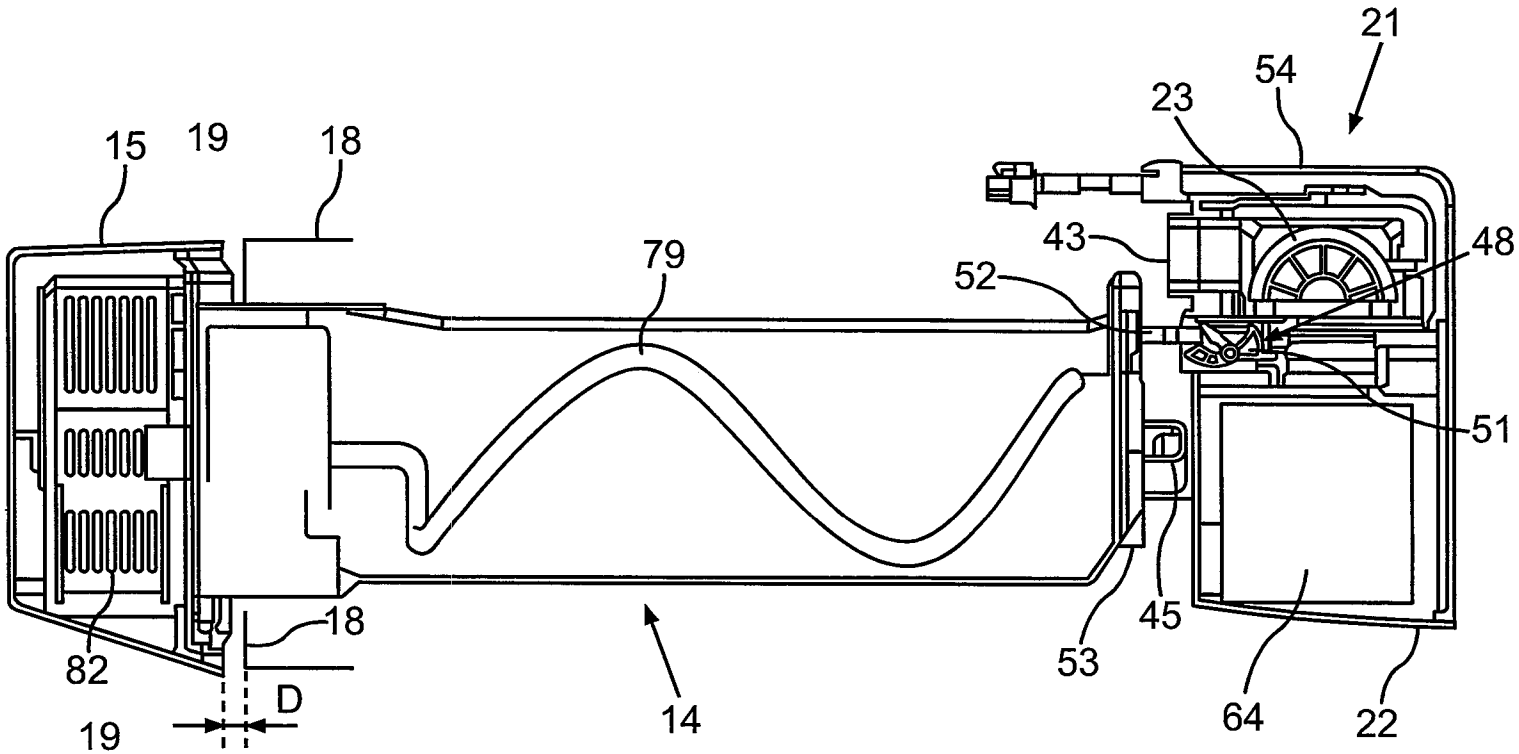
Figure 12B:
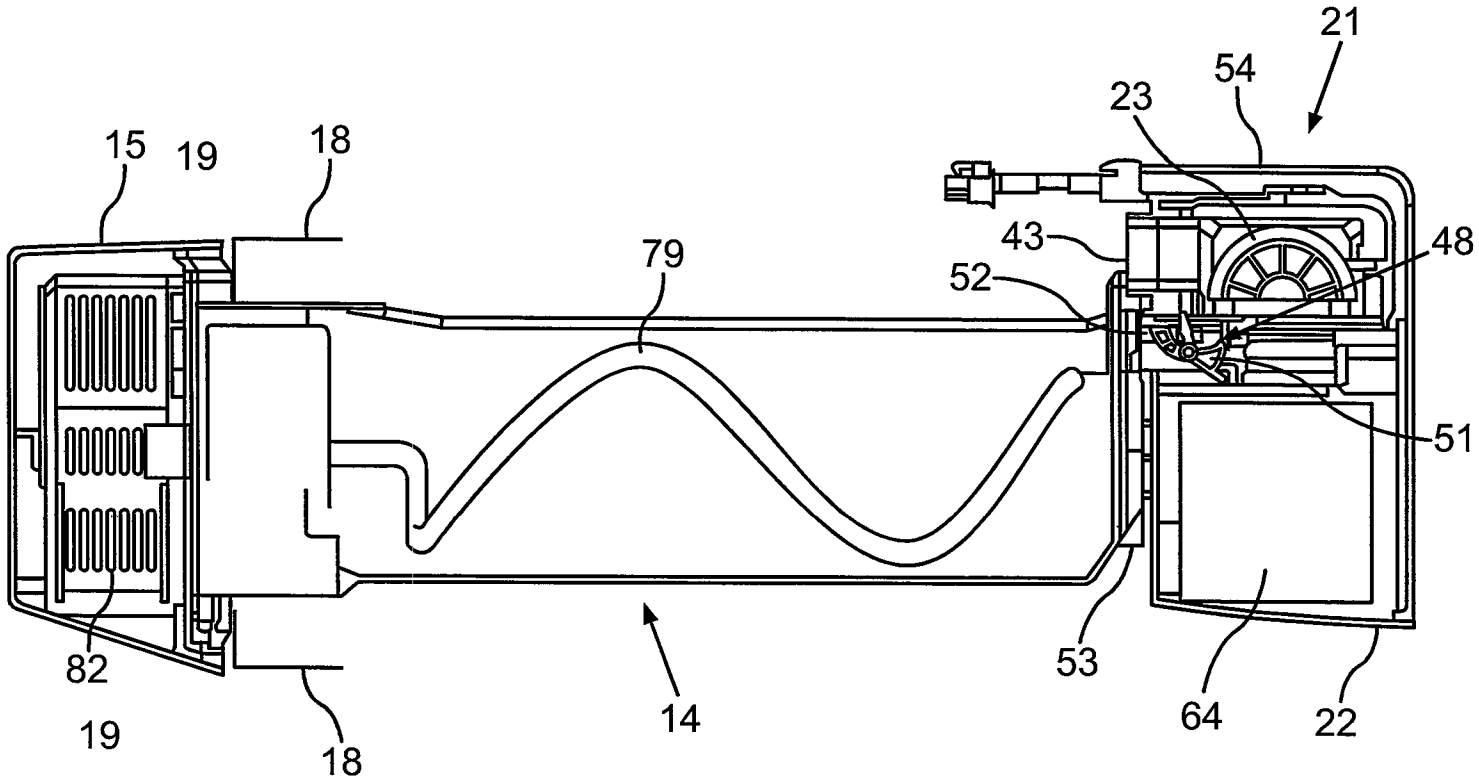
Figure 13A:
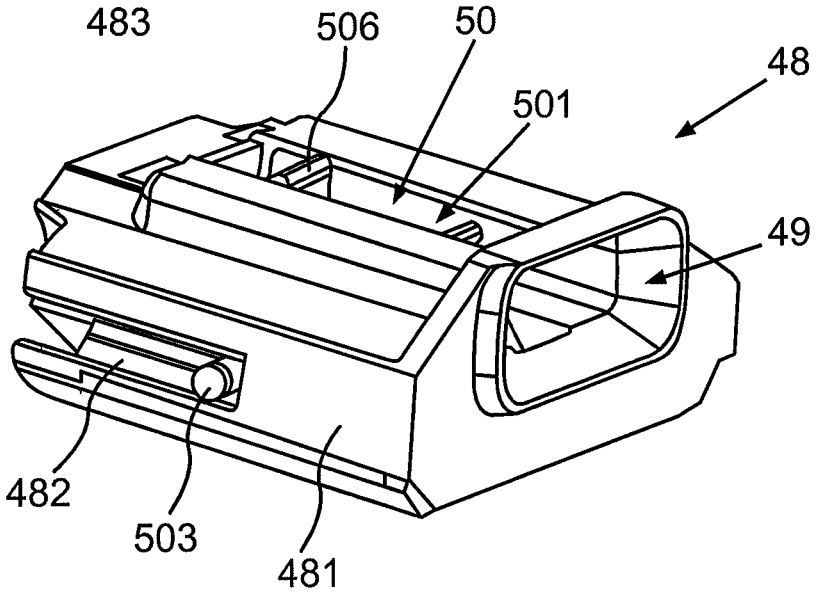
Figure 13B:
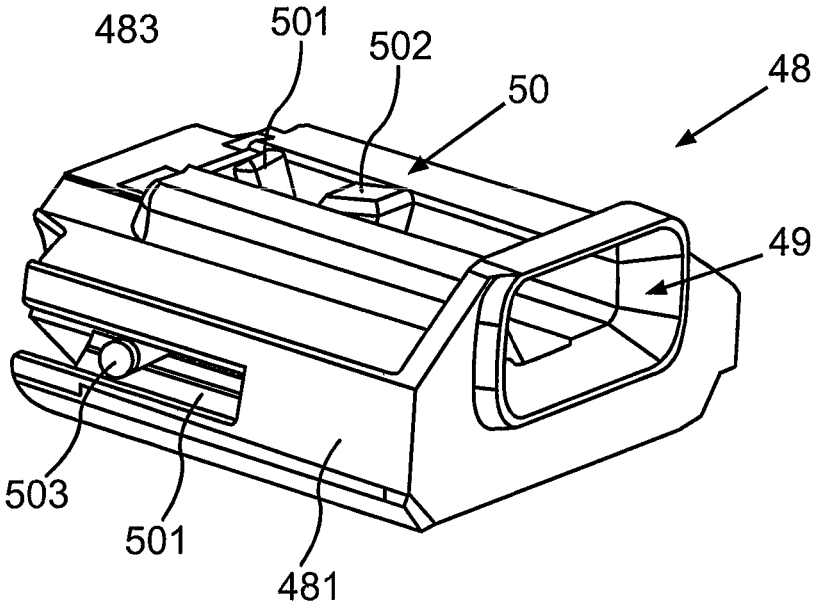
Figure 14A:
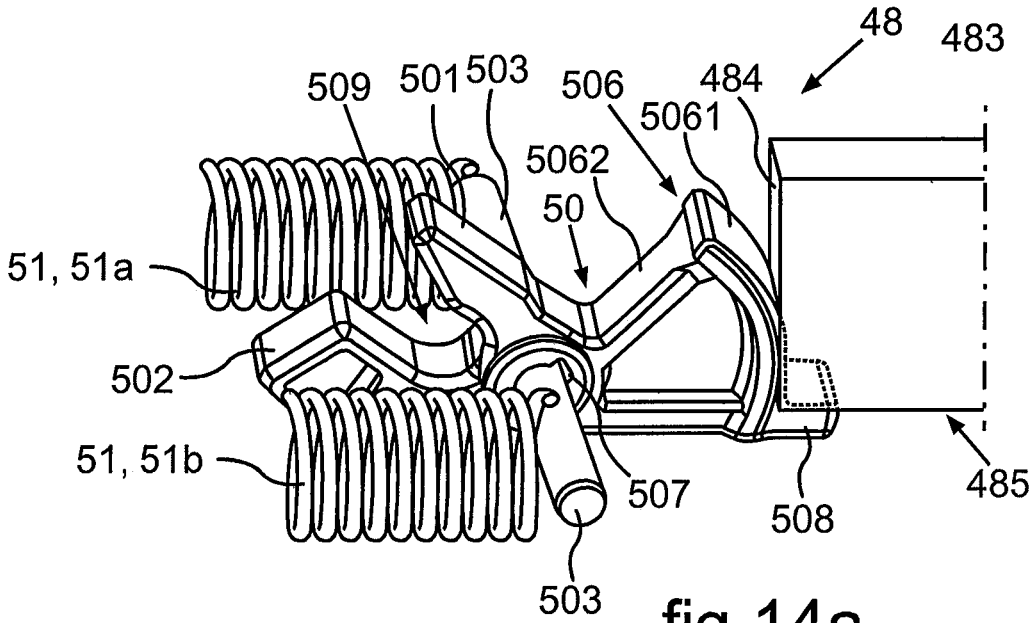
Figure 14B:
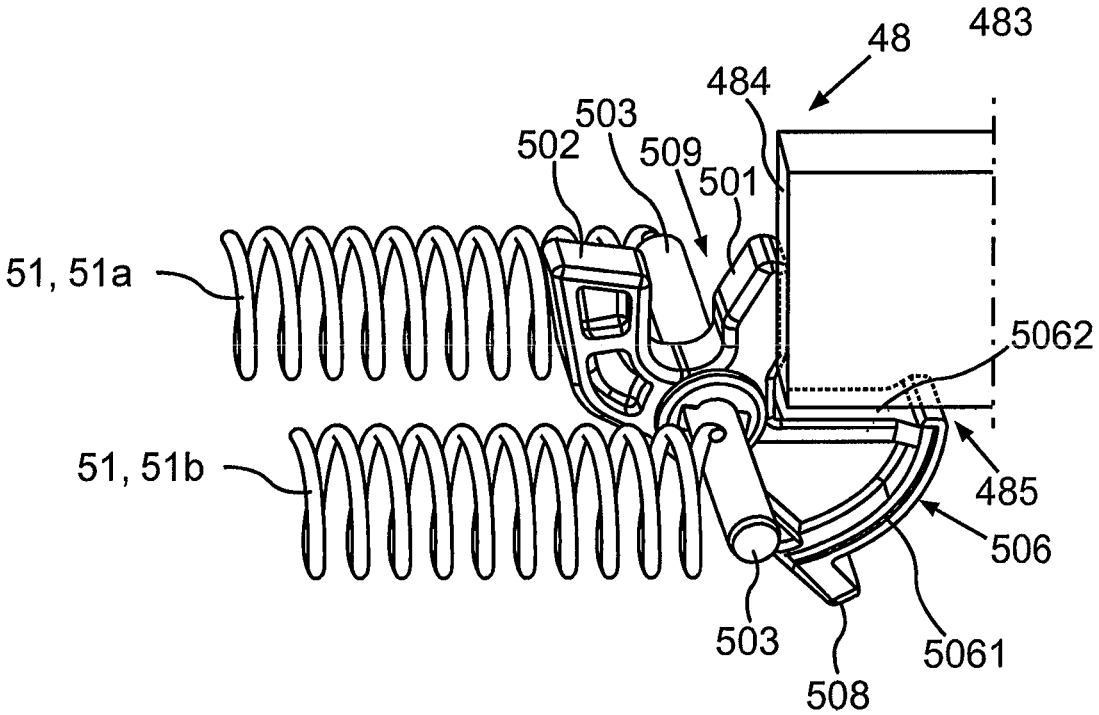

FIG. 12*a* is a sectional view of the ice maker according to FIG. 2 with a storage container in a released position;

FIG. 12*b* is a sectional view of the ice maker according to FIG. 2 with a storage container in a locking position;

FIG. 13*a* is a perspective view of an embodiment of a closing aid with housing in a basic position;

FIG. 13*b* is a perspective view of the closing aid with housing according to FIG. 13*a* in a snapped-over position;

FIG. 14*a* is a schematically perspective view of the closing aid according to FIG. 13*a* without the housing; and FIG. 14*b* is a schematically perspective view of the closing aid according to FIG. 13*b* without the housing.

DETAILED DESCRIPTION OF PREFERRED EMBODIMENTS

In the figures, identical or functionally identical parts are provided with the same reference signs.

With indications of "top", "bottom", "front", "rear", "horizontal", "vertical", "depth direction", "width direction", "height direction", etc., the positions and orientations given in intended use and intended arrangement of the apparatus are specified.

Figure 1:
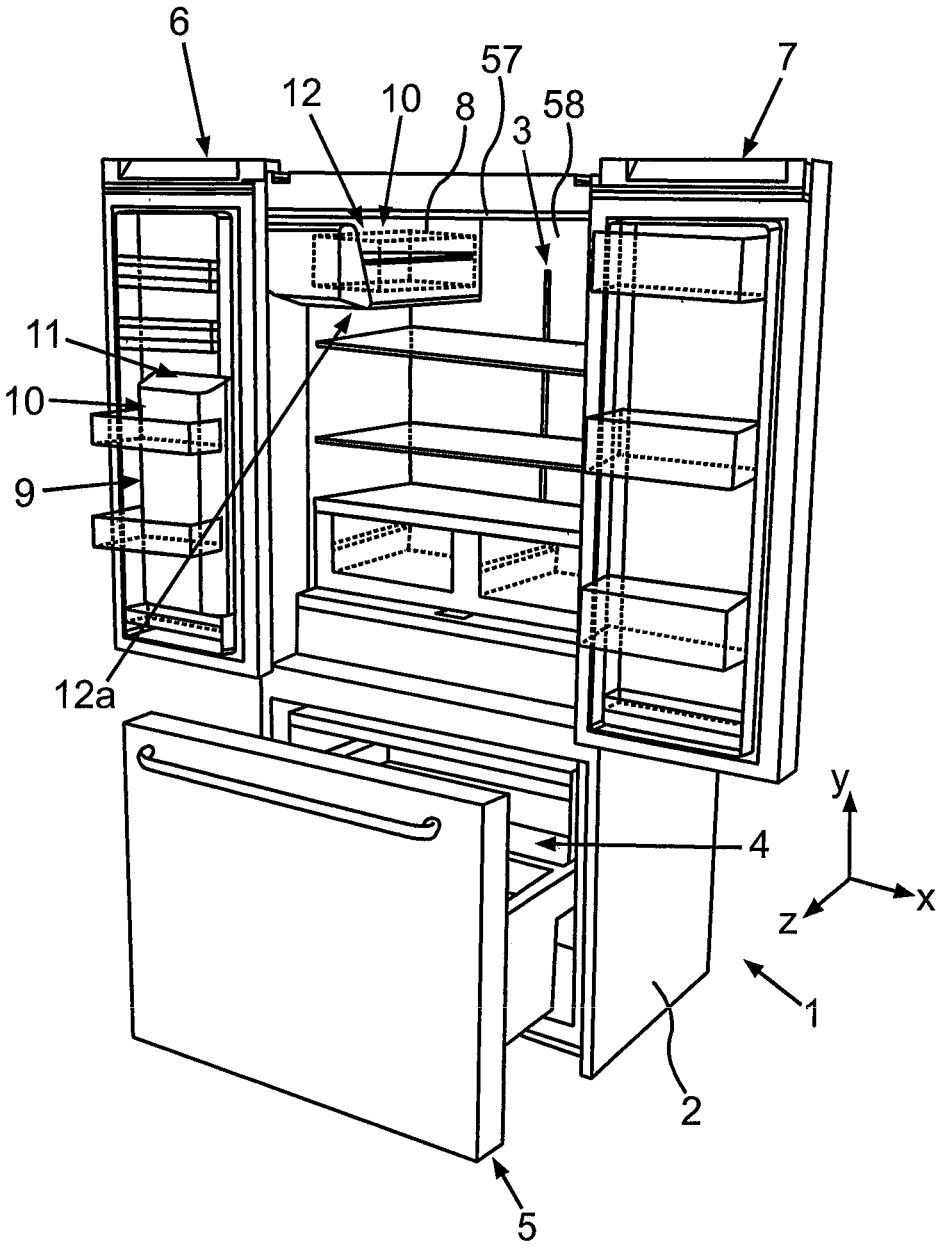
FIG. 1 is a perspective view of an embodiment of a household cooling appliance according to the invention.

In FIG. 1 in a perspective view an embodiment of a household cooling appliance 1 is shown. The household cooling appliance 1 is configured for storing and preserving food items. In the shown embodiment the household cooling appliance 1 is a fridge freezer combination appliance. However, it can also be only a cooling or refrigeration appliance.

The shown household cooling appliance 1 comprises an outer housing 2. In the outer housing a first receiving space for food items is configured, which here is a refrigeration compartment 3. In an embodiment, the household cooling appliance 1 moreover comprises a second receiving space for food items, which is separate from the first receiving space and which here is a freezer compartment 4. As can be recognized, in the embodiment shown here the refrigeration compartment 3 and the freezer compartment 4 are arranged one above the other in the height direction (y-direction) of the household cooling appliance 1. The freezer compartment 4, which is arranged further below, is capable of being locked by a door 5. The door 5 in the shown embodiment is a front wall of a drawer, which can be shifted linearly in the depth direction (z direction) of the household cooling appliance 1. The refrigeration compartment 3 is capable of being locked by two separate doors 6 and 7, which are shown in FIG. 1 in the opened state. The two separate doors 6 and 7 are capable of being pivoted about pivot axles, which are vertically oriented, and are arranged on the outer housing 2. The two doors 6 and 7 are arranged adjacent to each other in the width direction (x direction) and extend in the closed state in a front side plane. In particular, also the door 5 in the closed stated extends in this plane, in which also the two doors 6 and 7 extend in the closed state.

In an embodiment, the household cooling appliance 1 moreover comprises a dispenser 10 configured to output ice form elements or crushed ice. The dispenser 10 moreover can also optionally be configured to output a drink. In an embodiment, the household cooling appliance 1 comprises a module 8. In an embodiment, the dispenser 10 comprises said module 8.

The module 8 in the shown embodiment is arranged in the interior of the refrigeration compartment 3. This means that whilst the module 8 is arranged to be thermally insulated against the refrigeration compartment 3, however, that it is only accessible and reachable via the feed opening of the refrigeration compartment 3. Thus, the module 8 can only be made accessible, when at least the door 6 is opened.

The dispenser 10 in addition to the module 8 also comprises an output 9. The output 9 here is for instance configured to be integrally formed in the door 6. On an outer side of the door 6, which faces away from the refrigeration compartment 3 and then is also a front side, a niche is formed, in which a receiving container can be placed and in which then via the output 9 the ice form elements or the crushed ice can be output.

In the closed state of the door 6 the output 9 is coupled with the module 8 so that via an ice chute 11 formed here in the output 9 ice form elements or crushed ice can arrive at the output 9 from the module 8.

The module 8 can be an ice compartment 12*a*. The household cooling appliance 1 can then also be configured without an ice maker 12. The module 8 can also be an ice maker 12. The ice compartment 12*a* can be an integral part of the ice maker 12 if the household cooling appliance 1 comprises an ice maker 12.

In FIG. 1 an example for a household cooling appliance 1 comprising an ice maker 12 is schematically shown. The ice maker 12 is arranged in the refrigeration compartment 3. Viewed from the front side, it is arranged in a left top corner portion of the refrigeration compartment 3. The ice maker 12 is arranged to be thermally insulated from the remaining volume of the receiving space 3. The ice maker is only accessible, if the door 6 is opened.

In FIG. 2 in a perspective view an embodiment of the ice maker 12 is shown. The ice maker 12 comprises an ice producer 13. Moreover, the ice maker 12 comprises a storage container 14. In the storage container 14 the ice form elements produced in the ice producer 13 can be stored. In FIG. 2 a conveyor 79 (FIG. 11) is not shown. The conveyor 79 is arranged in the storage container 14. In an embodiment, the conveyor 79 is part of the ice compartment 12*a*. The conveyor 79 can be part of the ice maker 12. By the conveyor 79 the ice form elements stored in the storage container 14 are ejected from the ice maker 12 on demand. They then can be output via the ice chute 11 into the corresponding front side niche in the door 6. The storage container 14 is connected with a front wall 15 of the ice maker 12. The front wall 15 also represents a front wall of an outer housing 16 of the ice maker 12. The outer housing 16 moreover comprises an outer housing wall 17. The outer housing wall 17 is configured to be thermally insulated. The outer housing wall 17 is configured to comprise a vertical wall 17*a* and a bottom wall 17*b* integrally formed therewith. In particular, the outer housing wall 17 is configured with an L-shape.

In particular, the front wall 15 is configured to be separate from the outer housing wall 17. Preferably the ice maker 12 comprises a front frame 18. The front frame 18 is configured to be separate from the front wall 15. The front frame 18 is connected in particular with the outer housing wall 17. In the mounted state, as shown in FIG. 2, the front wall 15 contacts the front frame 18 directly. The front frame 18 can then also be referred to as front flange. In particular, the front wall 15 is pushed, in particular pressed to the front frame 18. Thereby a sealing state is achieved. In particular, between the front wall 15 and the front frame 18 a sealing 19 (FIG. 11) is arranged. The sealing 19 is in particular a sealing that is configured to be completely circumferentially extending or almost completely circumferentially extending. It can be arranged on a rear side 20 (FIG. 11) of the front wall 15. The front frame 18 is circumferentially closed. Thereby an opening 18*a* bounded by the front frame 18 is rendered. By this opening 18*a* the storage container 14 is inserted into the outer housing 16 from the front side.

Moreover, the ice maker 12 comprises a driving unit 21. The driving unit 21 is in particular configured to drive the conveyor 79 already mentioned in the above. In particular, here a driving by a drive motor is envisaged. Moreover, it may be envisaged that the driving unit 21 is configured for generating an air stream in the ice maker 12. In particular, here a cold air stream should be generated. The driving unit 21 is a separate module. The driving unit 21 thus is configured to be separate from the ice producer 13 and separate from the storage container 14. In the embodiment it is arranged at the rear end of the ice maker 12 viewed in the depth direction (z direction). The driving unit 21 comprises a drive housing 22. In the drive housing 22 functional units are arranged. A functional unit of the driving unit 21 can for instance be a fan for generating the air stream. A functional unit, however, can also be for instance a drive motor for driving the conveyor 79. The functional unit, however, for instance can also be an air duct.

Figure 3:
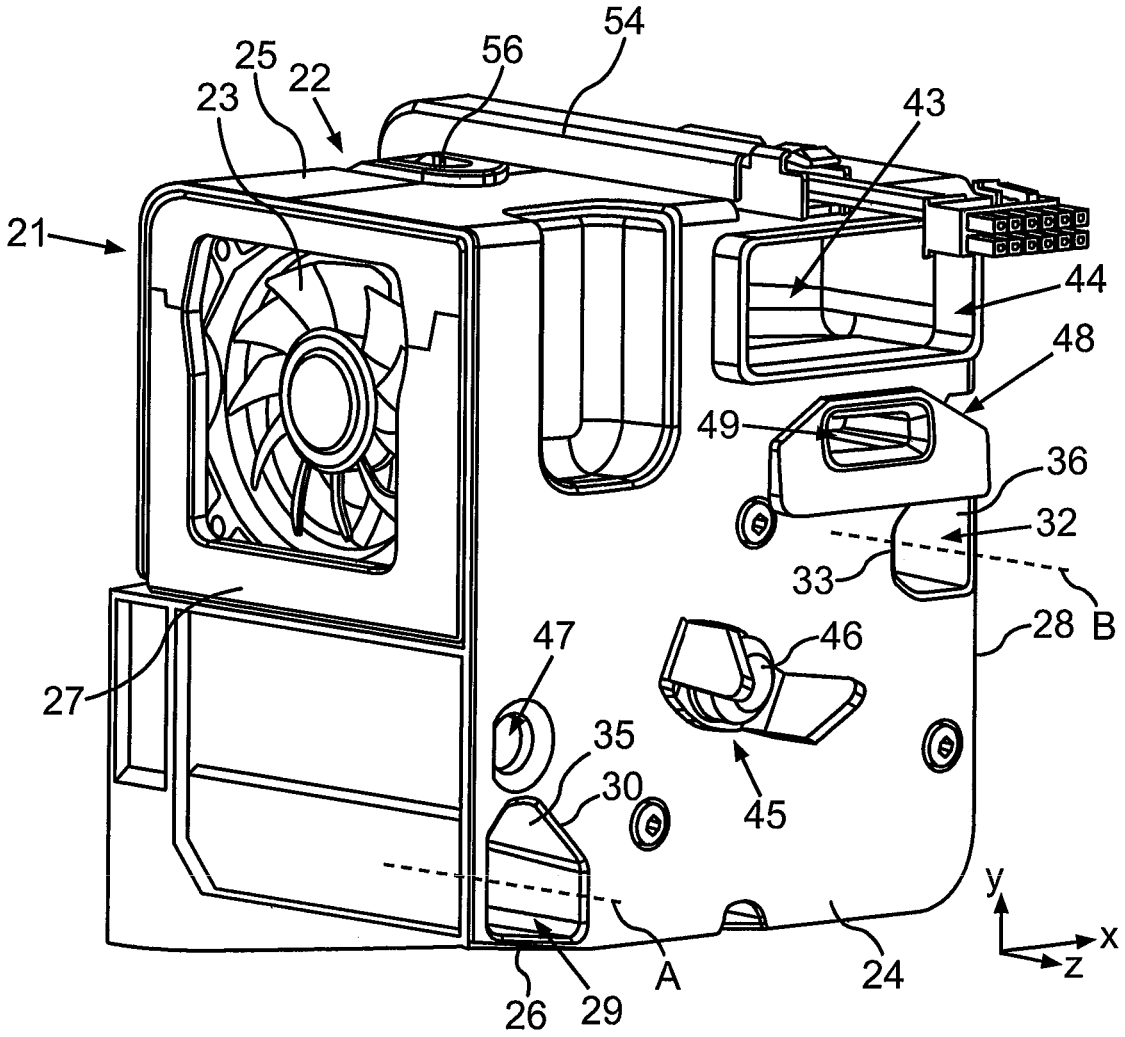
FIG. 3 is a perspective view of an embodiment of a driving unit of an ice maker.

FIG. 3 shows a perspective view of the driving unit 21 in an embodiment. Exemplarily, here also a fan 23 is shown, which is arranged in the drive housing 22. The drive housing 22 comprises a front wall 24. Moreover, the drive housing 22 comprises a roof wall 25 as well as a bottom wall 26. Moreover, viewed in the width direction (x-direction), also side walls 27 and 28 are provided. In particular, the drive housing 22 forms a cuboid shape. The drive housing 22 with regard to this shape is configured to have a housing wall at each side. Further the roof wall comprises an integrated cable channel 54.

The driving unit 21 comprises a first receiving duct 29. The receiving duct 29 is configured for receiving a first fastening part that is separate thereto to extend completely through the receiving duct 29. The fastening part, which is not shown in FIG. 3, can be a screw or a rivet or a bolt. Also a snapper or a bayonet part for generating a bayonet lock is feasible as fastening part. This fastening part can be inserted from the front through an entry 30 of the receiving duct 29. The receiving duct 29 is formed as a single piece with the drive housing 22. The first fastening part can then be inserted in the first receiving duct 29 in the depth direction towards the back. The first receiving duct 29, as this can be recognized in the front view on the front side 24 in FIG. 4, comprises a rear exit 31. The first receiving duct 29 extends in particular across the entire depth of the drive housing 22. The first receiving duct 29 thus is configured to extend completely through the drive housing 22, wherein this extension is viewed in the depth direction. The exit 31 is equally configured to be open towards the front. Thereby the fastening part can extend towards the rear out of the drive housing 22. By this first receiving duct 29 it is facilitated that the driving unit 21 can be mounted external to the ice maker 12. This means that the driving unit 21 can be fastened to a component of the household cooling appliance 1 that is different to the ice producer 13 and the storage container 14 and the wall 17. By the above-named exemplary fastening parts here a simple non-destructively releasable connection can be achieved. Thereby, a simple mounting concept is facilitated. In particular, it is thereby facilitated that a specific module of the ice maker, namely the driving unit 21 itself, can be individually fastened and thus can also be individually fastened at such a component of the household cooling appliance 1. Thereby the most varied individual mounting options and positioning of the driving unit 21 relative to other components of the ice maker 12 are also rendered possible in an improved way. The driving unit 21 can also be referred to as driving unit module or driving unit station.

The first receiving duct 29, as this has already been set out in the above, extends across the entire depth of the drive housing 22. It is configured to be open both at its front end or the entry 30 as well as at its rear end or the exit 31. Moreover, the driving unit 21 comprises a second receiving duct 32 (FIG. 3). The second receiving duct 32 is separate and spaced from the first receiving duct 29. In particular, also the second receiving duct 32 is integrated in the drive housing 22. It, too, is thus integrally formed therewith. The second receiving duct 32 equally comprises a front side entry 33. It equally extends in the depth direction up to the rear end of the drive housing 22. Also the second receiving duct 32 thus extends across the entire depth of the drive housing 22. As can be recognized in FIG. 4, the second receiving duct 32 comprises a rear exit 34. This exit 34 is open. Thereby, a further fastening part can be provided, which can be inserted through the entry 33 and can project through the exit 34 and the drive housing 22 towards the rear. Also it is thereby facilitated that the driving unit 21 can be fastened to a component that is separate from the driving unit 21. This means that the driving unit 21 can be fastened to a component of the household cooling appliance 1 that is different to the ice producer 13 and the storage container 14 and the wall 17. This component, to which the driving unit 21 is fastened by means of the second fastening part, which is inserted into the second receiving duct 32 and extends through it, is the same component, to which the driving unit 21 can be fastened by the first fastening part, which is inserted into the first receiving duct 31.

As can be recognized in FIG. 3, the first receiving duct 29 is oriented with its longitudinal axis A in the depth direction. The same is true for the second receiving duct 32, which is oriented with its longitudinal axis B in the depth direction. The longitudinal axes A and B are in particular oriented in parallel to each other. In the circumferential direction around the longitudinal axis A the first receiving duct 29 is fully bounded by bounding walls 35. The same is envisaged for the second receiving duct 32. It, too, in the circumferential direction around its longitudinal axis B is fully bounded by bounding walls 36. The receiving ducts 29 and 32 thus are designed to be tunnel-like or tube-like.

Figure 4:
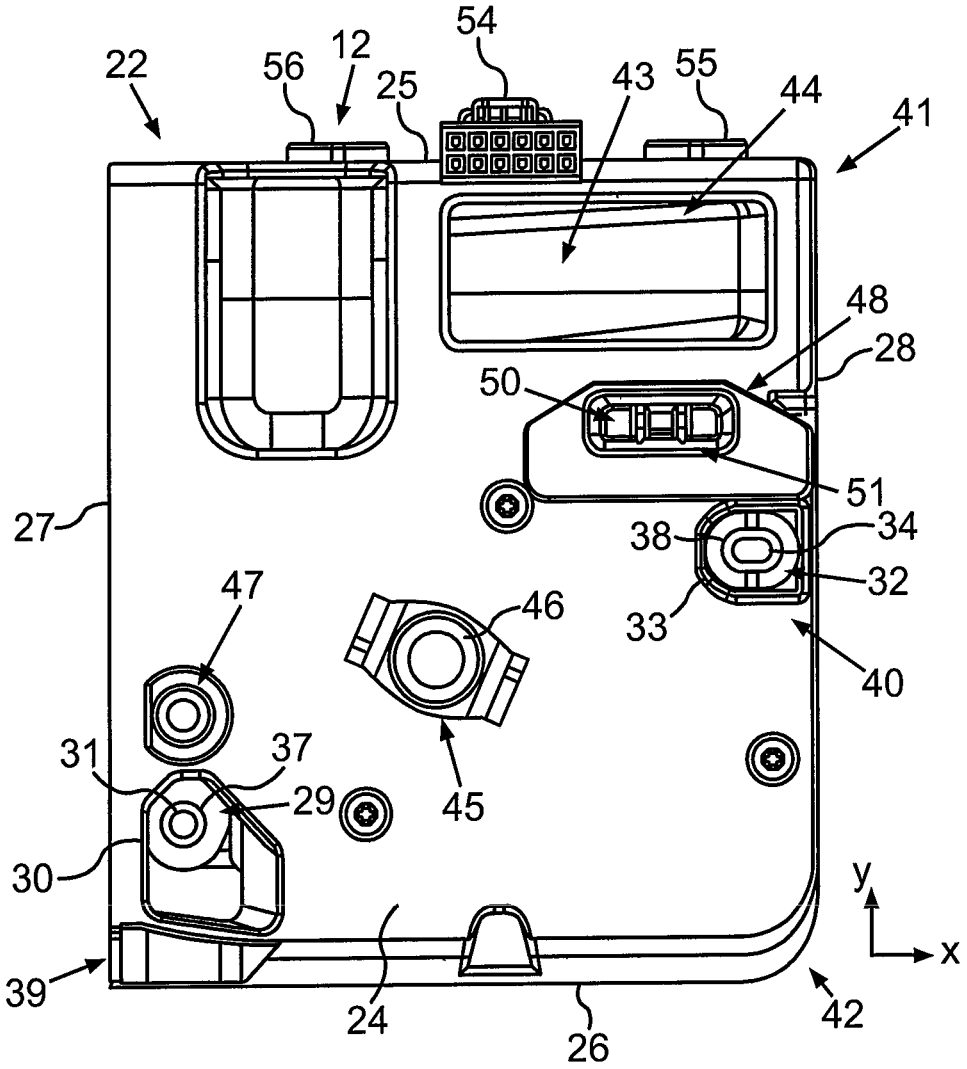
FIG. 4 is a front view of the drive unit according to FIG. 3.

As can be recognized in FIG. 4, the exit 31 is configured to be constricted, in comparison with entry 30. This means that the rear opening or the inner width of the exit 31 is smaller in terms of surface than is the case with the entry 30. In particular, it is envisaged that for this purpose a throat 37 or a constriction is configured. Thereby it is achieved that a fastening part with a broadened fastener head can be inserted via the entry 30 into the first receiving duct 29. However, this fastener head is retained to the exit 31. This means that the fastener head cannot be inserted through the exit 31. This is because the exit 31 with its recess hole is dimensioned too small for the fastener head to be capable of being passed through. This is achieved by the throat 37. The throat 37 can for instance also at least in portions be configured to be funnel-like or cone-shaped. Thereby a correspondingly complementarily shaped fastening head can be arranged to be recessed. Thereby the mechanical retention force is increased. Correspondingly, this can be envisaged for the second receiving duct 32. In particular here, too, the exit 34 in comparison with its entry 33 is configured to be constricted. Here, too, correspondingly a throat 38 or constriction can be envisaged. Also this is configured with regard to avoiding a passage or slipping of a fastener head of the further fastening part.

As can be recognized in FIG. 3 and FIG. 4, the two receiving ducts 29 and 32 are arranged offset relative to each other in the height direction (y direction). Additionally or instead, these receiving ducts 29 and 32 are offset relative to each other also in the width direction (x direction). In particular, here they are maximally offset relative to each other. The first receiving duct 29 is preferably arranged in a bottom left corner portion 39 of the drive housing 22. This is configured when viewing the front wall 24 from the front side. Preferably the second receiving duct 32 is formed in a lateral edge portion 40 of the drive housing 22. Moreover, in an advantageous embodiment it is configured to be at a distance from a top corner portion 41 and at a distance from a bottom corner portion 42 of the drive housing 22. In particular, the second receiving duct 32 is formed approximately half way up the height between the two corner portions 41 and 42.

The first receiving duct 29 comprises a, viewed in the depth direction, rear end portion 29*a* (FIG. 6), as this has already been explained in the above. In the depth direction viewed towards the front, the first receiving duct 29 comprises a front portion 29*b* extending therefrom. This rear end portion 29*a* comprises a constriction so that the rear end portion 29*a* viewed in the cross section perpendicular to the longitudinal axis A is smaller than the front portion 29*b*. This constriction is formed by the throat 37 that has already been explained. This constriction or throat 37 in an advantageous embodiment forms a stop and a passage barrier for a head of the fastening part, as it has already been set out in the above. This fastener head therefore cannot slip through this constriction or this throat 37.

The same is true in analogy for the second receiving duct 32. Here, too, the rear end portion and a front portion extending therefrom in the depth direction towards the front are configured. Here, too, the rear portion has a constriction or narrowing formed by the throat 38. Also thereby the rear end portion is smaller than the front portion viewed in the cross section perpendicular to the longitudinal axis B.

Moreover the driving unit 21 comprises an air duct 43 positioned inside the drive housing 22. From this air duct 43 an air stream L generated by the fan 23 can be guided in the driving unit 21 and thus in the drive housing 22 in a defined way. This air duct 43 of the driving unit 21 comprises an air duct outlet 44. Same is configured in the embodiment in the front wall 24 of the drive housing 22.

In a further advantageous embodiment it is envisaged that on the front wall 24 a passage 45 is formed. Through this passage 45 a shaft 46 of a drive motor 64 shown here (FIG. 7) can extend. The drive motor 64 can be arranged as functional unit in the drive housing 22. A conveyor 79 of the ice maker 12, which conveyor 79 has already been mentioned in the above and by which ice form elements can be conveyed out from the storage container 14, can be coupled by this shaft 46. Thereby the conveyor 79 is set in motion by the drive motor 64. For this purpose the conveyor 79 can comprise a counter-coupling part, which can be coupled in a non-destructively releasable manner to the shaft 46. However, it may also be envisaged that the counter-coupling part extends through the coupling part 45 into the interior of the drive housing 22 and only in the interior of the housing 22 can couple to a shaft 46 of the drive motor 64.

In a further advantageous embodiment it is envisaged that the driving unit 21 comprises a coupling guide 47 for mechanical coupling of the storage container 14 to the driving unit 21. For instance, the storage container 14 can comprise a counter-coupling part at its rear side, which can be inserted into the coupling guide 47. Thereby a mechanical coupling and a position centering of the storage container 14 relative to the driving unit 21 is facilitated. Preferably, this coupling guide 47 is configured immediately above the entry 30 of the first receiving duct 29. The coupling guide 47 can be integral part of a mechanical stick connection. However, it may also be integral part of a snap connection. The corresponding counter coupler 80 (FIG. 11), which is arranged at the storage container 14, then forms the respective counterpart for generating the stick connection or the snap connection. The counter coupler 80 can be a coupling pin. The counter coupler 80 is preferably configured to be integrally formed with the storage container 14. In an embodiment, the counter coupler 80 is said counter-coupling part.

In a further advantageous embodiment it may be envisaged that the driving unit 21 comprises a closing aid 48. This closing aid 48 can be configured as a separate module of its own. The closing aid 48 allows for the driving unit 21 with the storage container 14 to be held fixed in position. In particular, here a self-locking principle is facilitated so that the storage container 14 in the depth direction is led via a certain path independently to the driving unit 21, in particular drawn into the drive housing 22. In an advantageous embodiment it is thereby rendered possible that the front wall 15 resp. front cover of the ice maker 12, which is firmly connected with the storage container 14, equally automatically is drawn in the depth direction towards the rear. Thereby the front wall 15 with a defined pressing force is pressed to the front frame 18 or pulled towards the rear and a corresponding pressing force generated between the named components. Further, since the closing aid 48 is arranged at the driving unit 21, which is provided at the rear of the ice maker, the front wall 15 is free from any closing mechanisms of the ice maker. Further, the insulation provided in the front wall for thermally insulating the ice maker 12 or ice compartment 12*a* from the ambient is not weakened. Moreover, the customer is not forced to actuate any buttons or switches to release the front wall 15 or storage container 14 from the ice maker 12 or ice compartment 14.

The closing aid 48 comprises an insertion opening 49, as it can be recognized in FIG. 3. This insertion opening 49 is formed in the front wall 24. In an embodiment, this insertion opening 49, viewed in the height direction, is configured above the second receiving duct 32. In particular, this insertion opening 49, viewed in the height direction, is configured below the air duct outlet 44. Viewed in the width direction, this insertion opening 49, when viewing the front wall 24 from the front side, is configured to be adjacent to the edge portion 40. Thereby, viewed quasi in the height direction, in a sequence from top to bottom the arrangement of the air duct outlet 44, the insertion opening 49, and the entry 33 of the second receiving duct 32 is rendered. Preferably, the insertion opening 49 is arranged in a top half of the height, wherein here the height of the front wall 64 is viewed. The closing aid 48 can be configured as separate module of its own, which is inserted into the drive housing 22.

In FIG. 4 according to the viewing from the front side the closing aid 48 is shown. The insertion opening 49 (see FIG. 3) can be recognized. The closing aid 48 comprises a gripper 50, which can be recognized in the representation in FIG. 4. The gripper 50 is positioned inside a housing 481 (see FIG. 13*a*, 13*b*) of the closing aid 48 and thus arranged to be offset towards the rear in the interior of the housing 22. Moreover, the closing aid 48 comprises an energy storage 51, which is loaded in a basic position resp. in a unlocked or open position of the closing aid 48. The energy storage 51 is also arranged in the interior resp. within the housing 481 of the closing aid 48 and cannot be recognized in the representation shown in FIG. 4. It is therefore only indicated by the corresponding reference sign. By the energy storage 51 a snapping-over of the gripper 50 from a basic position into a snapped-over position is achievable, when the loaded energy storage 51 is changed from the loaded state to the unloaded state. This is effected by the fact that in case of an insertion of a coupling extension 52 (FIG. 11), which is arranged on a rear wall 53 (FIG. 11) of the storage container 14 and projects relative to the rear wall 53 towards the rear, into the insertion opening 49 of the coupling extension 52, contacts this gripper 50 in the basic position. By a further pushing of the storage container 14 towards the rear, the gripper 15 is pressed resp. turned towards the rear and thereby the loaded energy storage 51 is actuated. The gripper 50 during this contacting by the coupling extension 52, to start with, performs a rotary movement. The energy storage 51 is then released or then unload and the gripper 50 coupled therewith further performs a translational resp. linear movement towards the rear. By the operating principle, the gripper 50 is automatically moved linearly towards the rear by the energy storage 51. By the coupling extension 52 already being coupled to the gripper 50, in the case of this automatic snapping-over of the gripper 50 a pulling movement along of the coupling extension 52 in the depth direction towards the rear is effected. This is also the automatic dynamic process of the storage container 14 in the depth direction, which is caused by this closing aid 48. The further mechanisms resulting therefrom, as has already been explained in the above, are thereby achieved. In particular, this concerns the drawing of the storage container 14 to the front wall 24. In particular, however, this also concerns the sealing pressing of the front wall 15 to the front frame 18. Thus, an independent drawing of the front wall 15 into the locking position is effected. In particular, thereby also the storage container 14 is independently drawn into the closed end position towards the rear. In the case of a returning of the gripper 50 to the basic position this is preferably effected by the fact that the front wall 15 with the storage container 14 is pulled in the depth direction towards the front. Thereby the gripper 50, which is coupled with the coupling extension 52, is drawn towards the front. This is a translational movement, which at its end transitions into a rotary movement of the gripper 50. Thereby the gripper 50 then reaches its basic position again. The energy storage 51 is loaded again by this movement of the gripper 50, as it is coupled to the gripper 50. In particular, it is thereby pre-stressed. The energy storage 51 can be a spring or preferably a plurality of springs 51*a*, 51*b* (see FIG. 14*a*, 14*b*). However, also a different mechanical energy storage can be provided.

Figure 5:
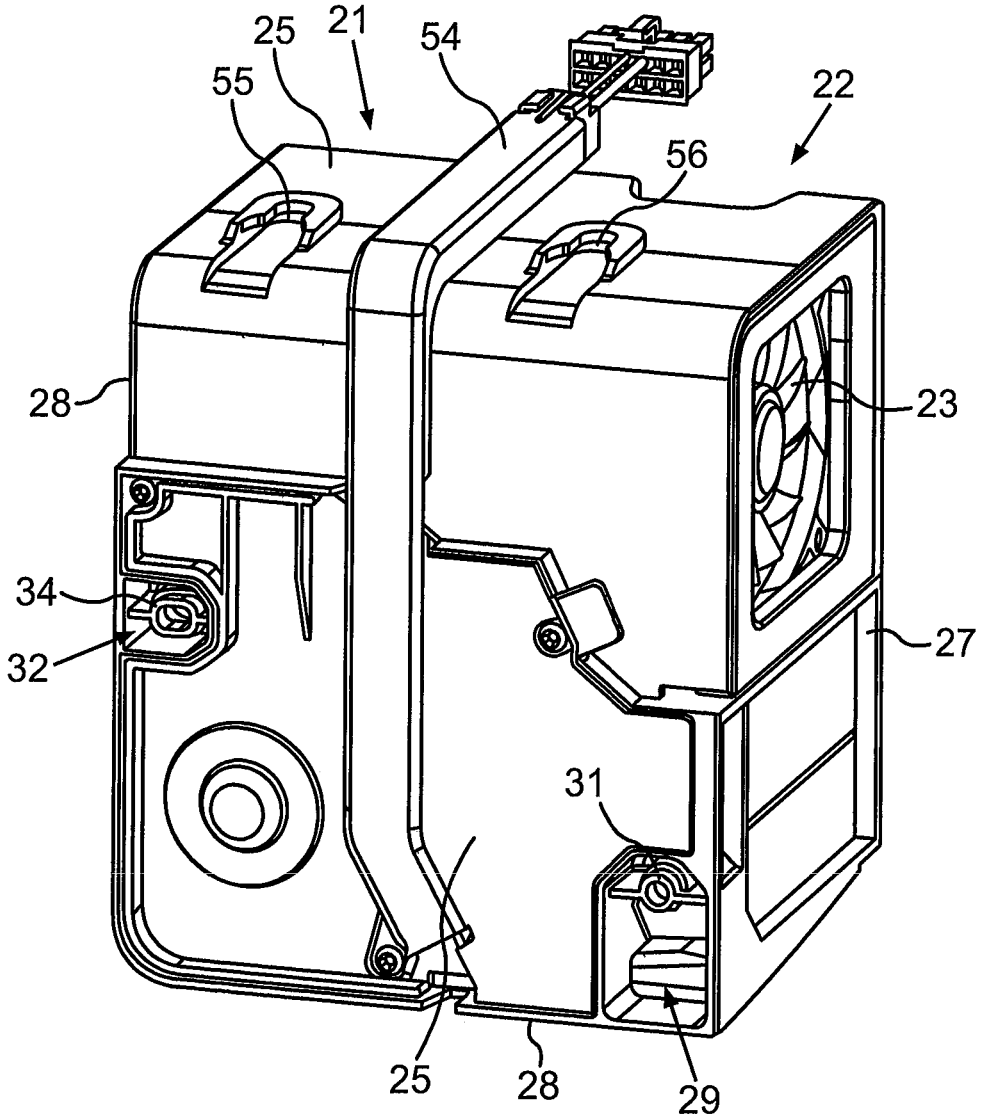
FIG. 5 is a further perspective view of the driving unit according to FIG. 3 and FIG. 4.

FIG. 5 once again shows the driving unit 21 as corresponding separate module. In FIG. 5 here the representation of the rear wall 25 of the drive housing 22 is shown. The exits 31 and 34 of the receiving ducts 29 and 32 can be recognized. The correspondingly constricted passages can be recognized.

Thereby in FIG. 5 in a manner corresponding to FIG. 2 and FIG. 3 it can be recognized that in the roof wall 25 of the drive housing 22 coupling entries 55 and/or 56 are formed. These coupling entries 55 and/or 56 can be engaged by counter couplers. Thus, the driving unit 21 can also be fastened to a ceiling wall 57 (FIG. 1) of an inner liner 59 of the household cooling appliance 1. In particular, thereby a suspension can be effected. In addition to the non-destructively releasable connections to a rear wall 58 of this inner liner 59 by the fastening parts and the receiving ducts 29 and 32 thus an additional mechanical fastening to the inner liner 59 can be effected. In an embodiment thus the component, to which the driving unit 21 is fastened is the rear wall 58. This is effected by fastening parts, which are horizontally inserted into the receiving ducts 29 and 32. A further component, to which the driving unit 21 can be fastened, is the roof wall 57 of this inner liner 59. The inner liner 59 by its walls bounds the refrigeration compartment 3. In particular, it bounds the refrigeration compartment 3 thereby directly.

Figure 6:
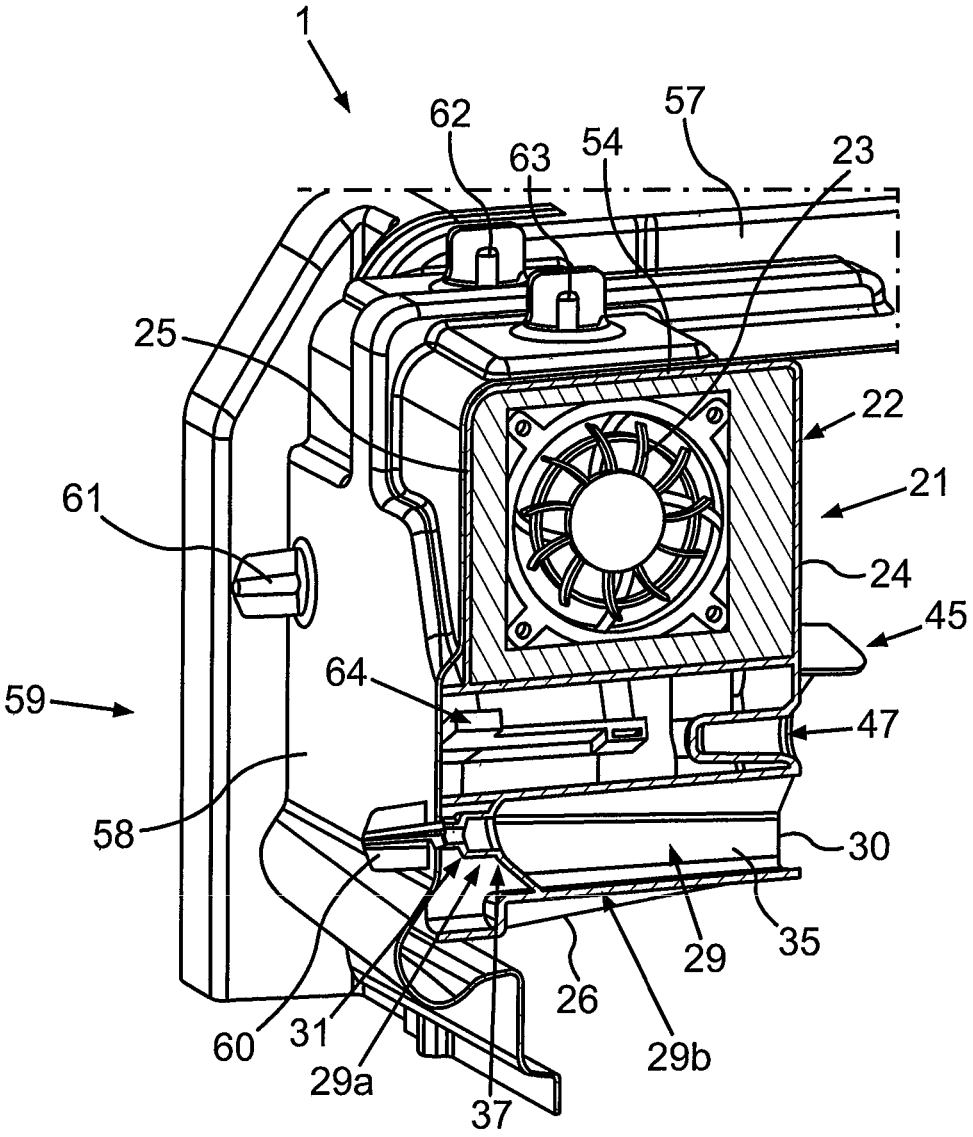
FIG. 6 is a perspective section view of the driving unit according to FIG. 3 to FIG. 5 in the installed state on a wall of an inner liner of the household cooling appliance.

In FIG. 6 in a perspective view a partial portion of the household cooling appliance 1 is shown. Here the inner liner 59 is partially shown. In particular, the rear wall 58 and the roof wall 57 is shown. The driving unit 21 is shown in the installed state. In FIG. 6 a perspective sectional view is shown. The sectional plane here is drawn through the first receiving duct 29. As can be recognized, at an outer side of the rear wall 58 a reinforcement part 60 is arranged. This comprises a receiving portion, into which the fastening part (not shown) can be inserted. In particular, this may for instance be a screw boss, into which a screw representing a fastening part can be screwed. Equally, this, however, can also be for instance a bolt duct or a rivet duct. Also a socket for a snap connection can be configured in the reinforcement part 60. A further reinforcement part 61 can be recognized. Same is arranged in the portion at the rear side of the rear wall 58, on which the exit 34 of the second receiving duct 32 is arranged. Moreover corresponding couplers 62 and 63 are shown as reinforcement parts that are arranged at the outer side of the roof wall 57 of the inner liner 59. Therein the corresponding options for coupling to the coupling entries 55 and 56 are facilitated. In the inserted state of a first fastening part into the first receiving duct 29 a head of a fastening part contacts the entry of the constriction or the throat 37 and extends towards the rear through the constricted rear end portion 29*a* of the first receiving duct 29 through the rear wall 58 into the reinforcement part 60. Accordingly, the second fastening part is arranged in the second receiving duct 32 and extends accordingly into the further reinforcement part 61.

For mounting, as this can be recognized in FIG. 6, a separate fastening part is pushed through via the front side of the ice compartment 12*a* or the ice maker 12, in particular through the front frame 18, and inserted into the first receiving duct 29. The module with the front wall 15 and the storage container 14 in this mounting state is not yet present. This first fastening part is then pushed within the receiving duct 29 far enough towards the rear to reach through the rear wall 58 and to be inserted into the reinforcement part 60. It is then correspondingly fastened so that a stable holding of the driving unit 12 is reached. The same is performed before or after with a second fastening part, which in an advantageous way is equally inserted through the front frame 18 in the depth direction and then introduced into the second receiving duct 32, is passed through the rear wall 58 and inserted into the reinforcement part 61.

Figure 7:
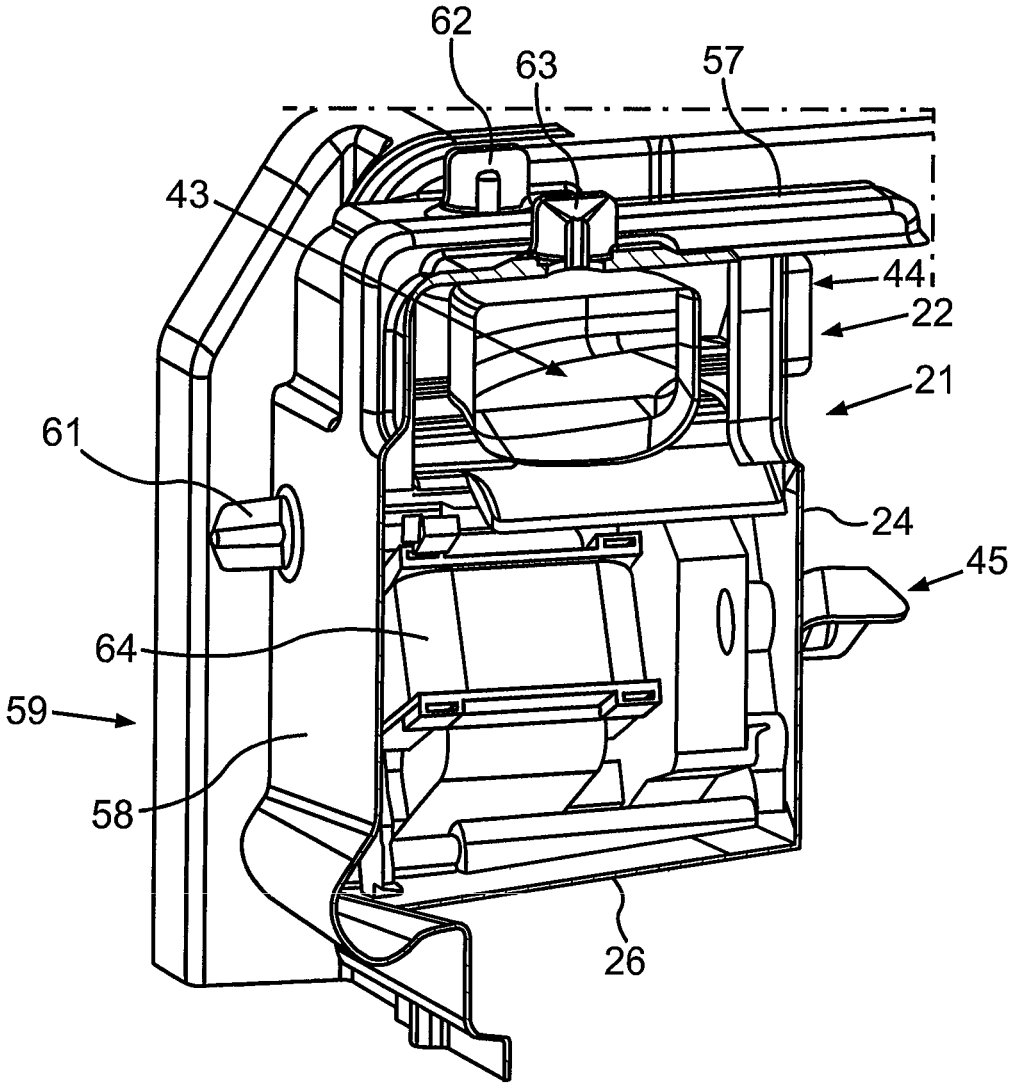
FIG. 7 is a perspective sectional view of the arrangement according to FIG. 6 in a sectional plane that is different therefrom.

In FIG. 7 a representation according to FIG. 6 is shown, with the sectional plane, however, being shown in a different way than in FIG. 6 partly through a coupler 63. The drive motor 64 can be recognized equally as in FIG. 6.

Figure 8:
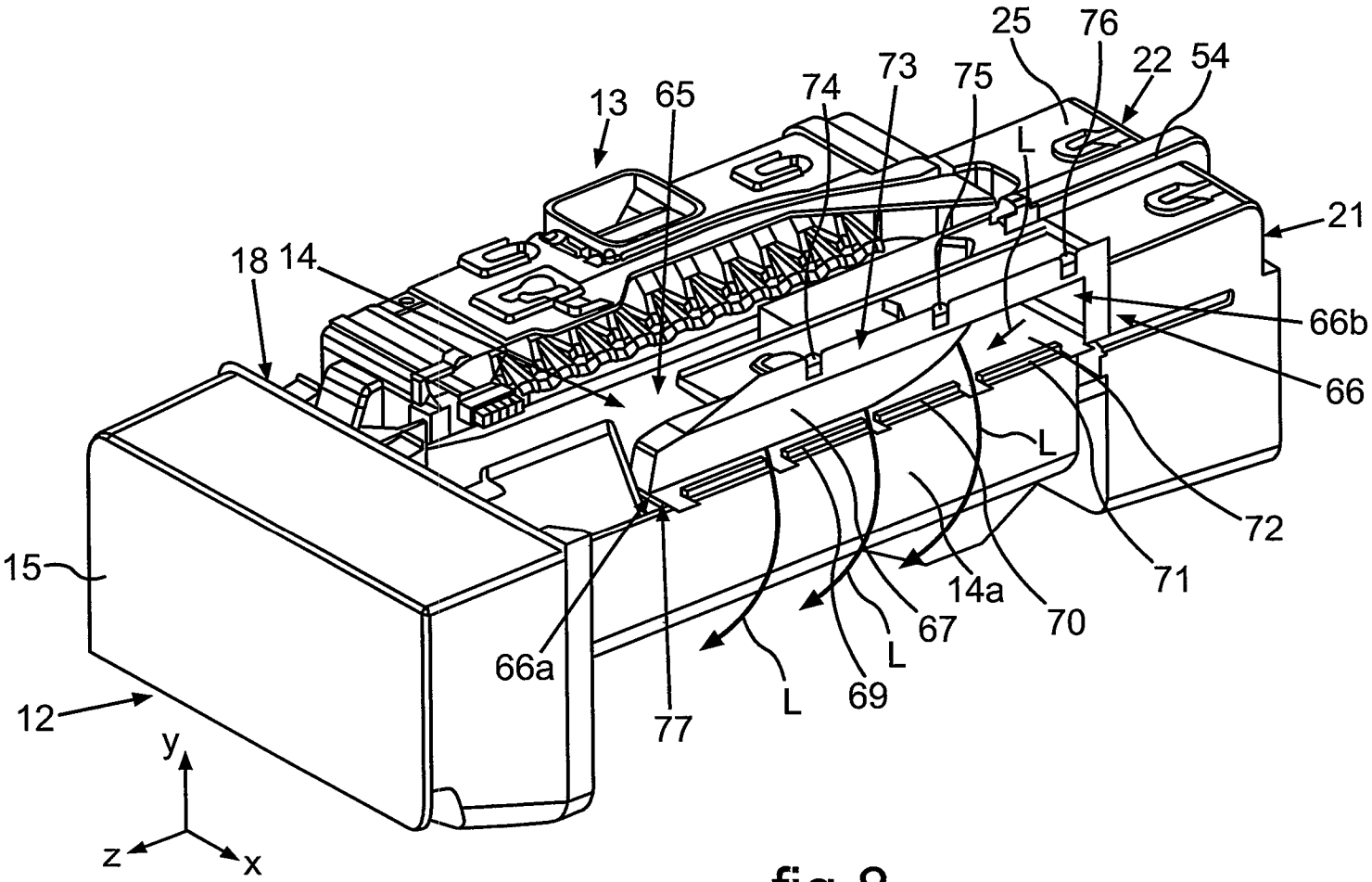
FIG. 8 is a perspective view of the ice maker with removed housing wall of an outer housing.

In FIG. 8 in a further perspective view the ice maker 12 is shown. The storage container 14 comprises an opening 65. The opening 65 is directed upward so that the storage container 14 is accessible from the top via this opening 65. The storage container 14 moreover has an outer side 14*a*. This is the outer side 14*a* of the walls of the storage container, which bound the volume of the storage container 14. The walls of the storage container 14 are a first side wall, a bottom wall that is adjacent to first side wall, and a second side wall that is adjacent to the bottom wall. The bottom wall is positioned opposite the opening 65, when viewed in the height direction. The storage container 14, viewed in a cross section perpendicular to the depth direction, is configured to be U-shaped.

The ice maker 12 moreover comprises an air guiding duct 66. The air guiding duct 66 comprises a first lateral duct wall 67. This first lateral duct wall 67 extends in the depth direction of the ice maker 12 and extends in the height direction of the ice maker 12. The air guiding duct 66 moreover is bounded by a second duct wall 68. The second duct wall 68 is a roof wall. The air guiding duct 66 comprises at least one opening 69, which is open towards the bottom. In particular, in an embodiment three such openings 69, 70, and 71 are configured. All of these are configured to be open towards the bottom. An air stream L flowing through the air guiding duct 66 by the geometry of the duct walls and their arrangement relative to each other is released from the air guiding duct 66 towards the bottom. This is effected by the openings 69, 70, and 71.

The air guiding duct 66, viewed in the width direction of the ice maker 12, is arranged offset relative to the opening 65 of the storage container 14. In particular, this offset arrangement is such that the air stream L exiting from the first opening 69, 70, 71 of the air guiding duct 66 flows around the storage container 14 at its outer side 14*a*. In particular, the arrangement of the first openings 69, 70, and 71 to the storage container 14, in particular its opening 65 toward the top, is such that no overlapping in the width direction is given. The exiting of the air stream L from the openings 69, 70, 71 thereby is not effected via the opening 65 into the storage container 14. The air stream L thus only flows around the storage container 14 at its outer side 14*a*.

In particular, the air guiding duct 66 comprises a bottom wall 72. In this bottom wall 72 the first openings 69, 70, 71 are formed. Through the bottom wall 72 the opening 65 of the air guiding duct 66 is also covered in the portion, in which it overlaps in the width direction with the opening 65. Thereby no air stream flows through the opening 65 into the storage container 14. In particular, by the first lateral duct wall 67 and the second duct wall 68 showing the roof wall the air stream L is conducted into the air conduction duct in the depth direction of the ice maker 12. The first lateral duct wall 67, the second duct wall 68, and in particular the bottom wall 72 are integrally formed with each other as a single piece. In particular, a component 77 is thereby formed, in particular from plastic. The first lateral duct wall 67 is configured to be uneven. It is curved in an arch-shaped manner. In particular, at the rear end facing the driving unit 62, in particular a rear half, an arch-shaped curvature is configured. A curvature is provided only in one direction. In particular, the curvature is directed towards the ice producer 13.

Preferably the air guiding duct 66 comprises a second lateral duct wall bounding the air guiding duct 66 at the side opposite the first lateral duct wall 67. In particular, this second lateral duct wall is formed by an outer housing wall of the outer housing 16 of the ice maker 12. The outer housing wall is in particular formed by the wall 17*a*, as it is shown in FIG. 2. This wall 17*a*, however, is a wall that is separate from the walls 67, 68, and 72. In the assembled state the component 77 with the walls 67, 68, and 72, viewed in the width direction, directly contacts the inner side of the outer housing wall 17*a*.

As can be recognized moreover in FIG. 8, the component 77 with the integrally formed walls 67, 68, and 72 comprises a flange 73. This flange 73 is in particular L-shaped. It is envisaged for contacting the inner side of the outer housing wall 17*a*. In an advantageous embodiment in this flange 73 resilient parts 74, 75, and 76 are configured to be integrally formed with each other as a single piece. Thereby in the mounted state a pressing of this 77 to the outer housing wall 17*a* is achieved.

Figure 9:
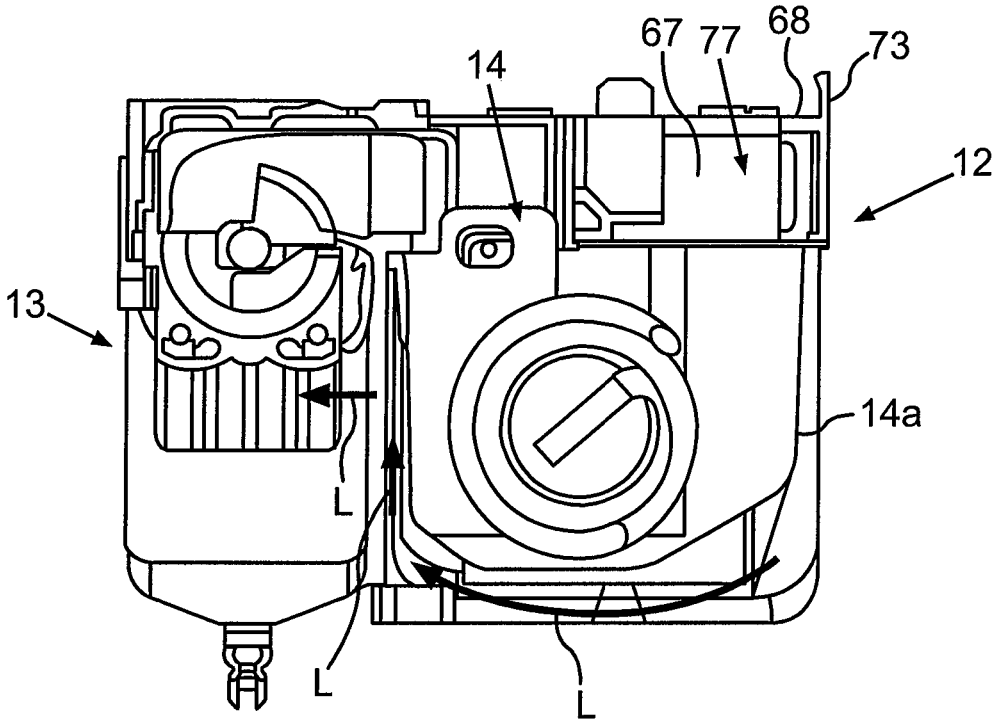
FIG. 9 is a vertical sectional view of the embodiment according to FIG. 8.

The component 77, which is formed as a single piece and comprises the walls 67, 68, and 72 as well as the flange 73, is arranged in non-destructively releasable manner at the driving unit 21. For this purpose the driving unit 21 comprises a coupler oriented in the depth direction towards the front. This component is fitted upon this coupler. This component 77 in FIG. 9 is shown in the sectional view, as is the storage container 14 and the ice producer 13. The progression of the air stream L is shown in FIG. 9. It can be recognized that this fully flows around the storage container 14 at its outer side 14*a* and then enters the ice producer 13.

The air guiding duct 66, viewed in the depth direction, comprises a front end 66*a* and a rear end 66*b*. The air guiding duct 66 narrows, in particular continuously, starting from the rear end 66*b* towards the front up to the front end 66*a*. Thereby a pressing of the airstream L outward out of the openings 69, 70, 71 is supported.

Figure 10:
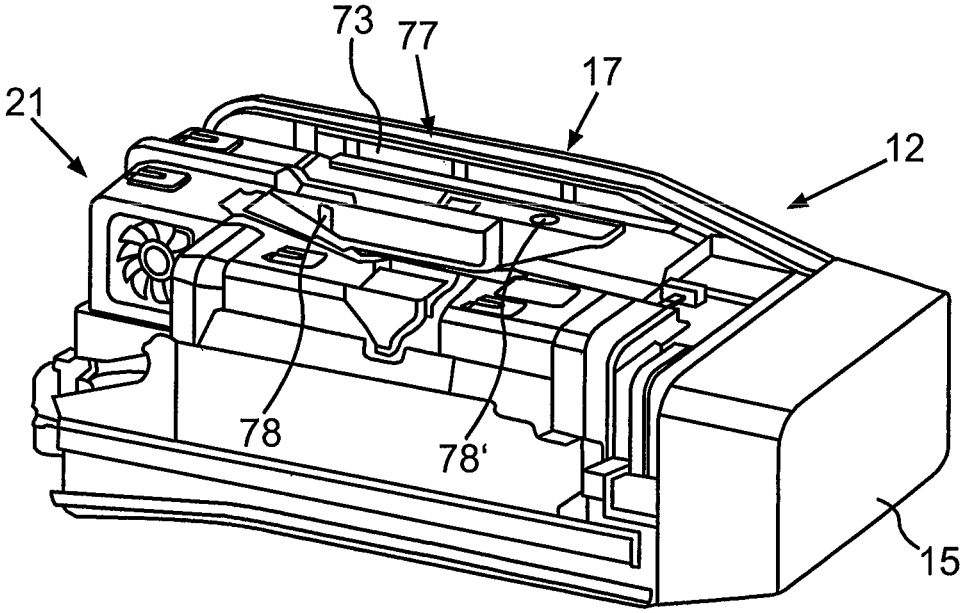
FIG. 10 is a further perspective view of an embodiment of an ice maker.

In FIG. 10 in a further perspective view the ice maker 12 is shown. The component 77 moreover comprises further openings 78, from which the air stream L can exit towards the top. Thereby additionally an air stream can directly reach the ice producer 13. A further opening 78' corresponding with fixation element on the ceiling of the ice compartment 12*a* for mounting of the air guiding duct 66 to the ice compartment 12*a*. The ceiling of the ice compartment 12*a* is a portion of the inner liner of the refrigeration compartment 3.

Figure 11:
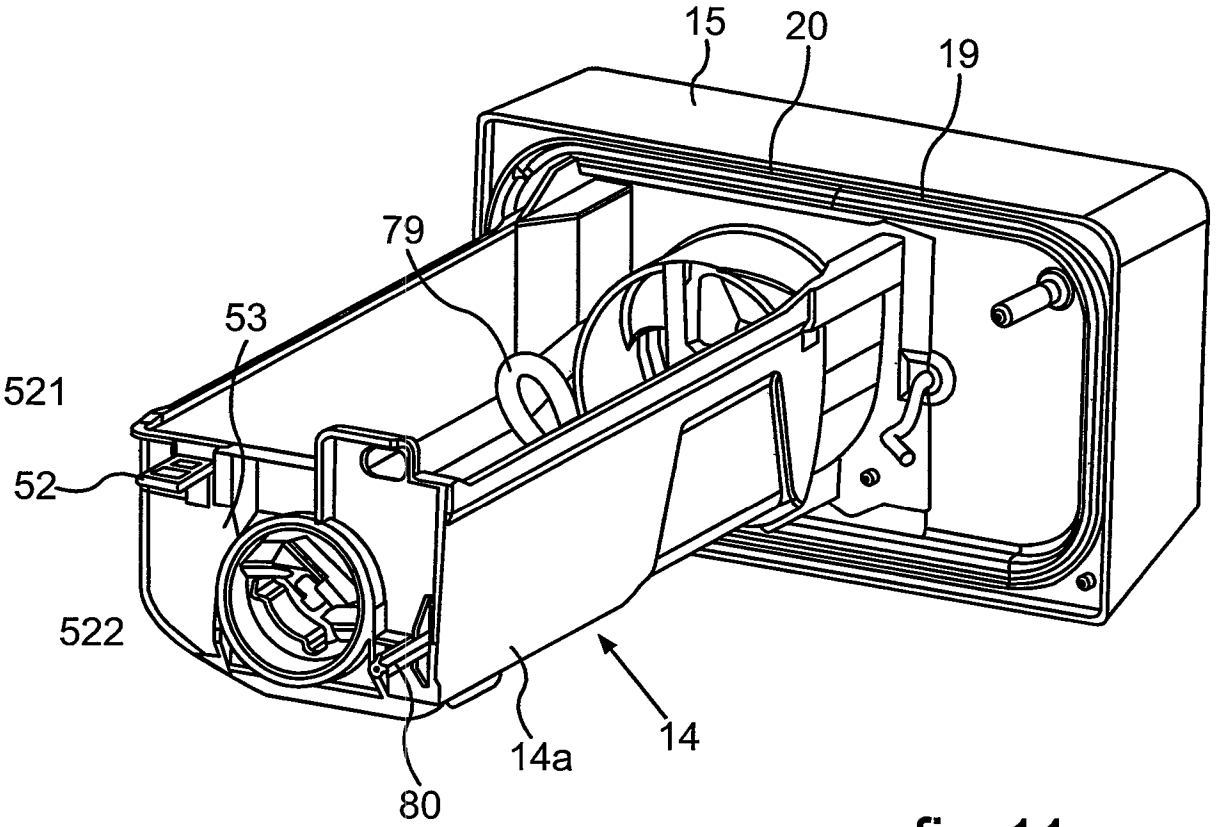
FIG. 11 is a perspective view of partial components of the ice maker.

In FIG. 11 is shown a perspective view of the storage container 14 with the front wall 15. A sealing 19 is provided on a rear side of the front wall 15 in order to prevent entry of humidity and warm air from the ambient into the ice maker 12. The sealing 19 is in particular, a sealing 19 that is configured to be completely circumferentially extending or almost completely circumferentially extending. It is arranged on a rear side 20 of the front wall 15. In the storage container 14 is also arranged the conveyor 79. The coupling extension 52 is configured in particular as loop. The coupling extension 52 protrudes from a rear wall 53 of the storage container 14 in the depth direction of the ice maker 12 resp., in a mounted state of the storage container 14, in direction of the driving unit 21 (see FIG. 2 or 8). The coupling extension 52 comprises a frame bounding a cut-out 522 and forms a cross bar 525 at its free end. In this embodiment, the coupling extension 52 is integrally formed with the storage container 14. The coupling extension 52 may be formed separately to the storage container 14 and connected to the storage container by a snap-fit connection or screw connection. A gripper 50 (see FIGS. 12*a*, 12*b*) of the closing aid 48 can project through the cut-out 521 and engages with the cross bar 522 in order to cause a pull force on the coupling extension 52 resp. storage container 14.

In FIG. 12*a* is shown in principle a sectional view of the ice maker 12 with a storage container 14 in a released position. A sealing 19 is provided on a rear side of the front wall 15 in order to prevent entry of humidity and warm air from the ambient into the ice maker 12. The sealing 19 is in particular a sealing 19 that is configured to be completely circumferentially extending or almost completely circumferentially extending. It is arranged on a rear side 20 of the front wall 15. In the front wall 15 is arranged a crushing unit 82 for crushing the cubed ice stored in the storage container 14 which conveyed to the crushing unit 82 by turning movement of a conveyor 79 provided in the storage container 14. The cubed or crushed ice can be discharged through an opening (not represented) in the front wall 15 into an ice chute 11 of the output 9 (see FIG. 1). The driving unit 21 is positioned at a rear end viewed in depth direction of the ice maker 12 resp. opposite to the front wall 15. The driving unit 21 comprises an air duct 43 positioned inside the drive housing 22. From this air duct 43 an air stream L (see FIG. 7) generated by the fan 23 can be guided in the driving unit 21 and thus in the drive housing 22 in a defined way. This air duct 43 of the driving unit 21 comprises an air duct outlet 44. Same is configured in the embodiment in the front wall 24 of the drive housing 22. The air duct 43 guides the air stream L from the fan 23 to the air duct outlet 44 of about an angle of 90 degree. Accordingly, the air duct 43 is formed with a curved section, which has an angle of about 90 degree (see detail at FIG. 7). The driving unit 21 further comprises a closing aid 48 with an insertion opening 49 at a front side 24 of the drive housing 22, which can be recognized in detail in FIG. 4. The closing aid 48 comprises a gripper 50. The storage container 14 comprises a coupling extension 52 configured in particular as loop. The coupling extension 52 protrudes from a rear wall 53 of the storage container 14 in depth direction to the rear of the ice maker 12 or in other words, in a mounted state of the storage container 14, in direction of the driving unit 21 (see FIG. 2 or 8). The coupling extension 52 comprises a frame bounding a cut-out 522 and forms a cross bar 525 (see FIG. 11) at its free end. The coupling extension 52 is integrally formed with the storage container 14. By further inserting of the storage container 14 resp. the coupling extension 52 in depth direction on the driving unit 21. In the nearly closed end position of the storage container 14 according to FIG. 12*a*, the coupling extension 52 contacts the gripper 50 in the basic position resp. unlocked position or non-activated position. In this position, the front wall 15 or at least the seal 19 resp. gasket is not in contact with front frame 18 of the ice maker 12 and it remains a certain gap D resp. distance between the rear wall 20 (see FIG. 11) of the front wall 15 and the front frame 18. By further inserting of the coupling extension 52 (see FIG. 11) into the insertion opening 49 of the closing aid 48, the closing aid 48 resp. the gripper 50 would be activated which is further described to FIG. 12*b*.

In FIG. 12*b* is shown a sectional view of the ice maker 12 with a storage container 14 in a locked position. In contrast to FIG. 12, the storage container 14 is in the closed end position resp. completely retracted into the ice maker 12. By further inserting of the coupling extension 52 (see FIG. 11) into the insertion opening 49 of the closing aid 48, the gripper 50 undergoes a rotational movement about an rotational axis. After the rotational movement of the gripper 50, the gripper 50 projects through the cut-out 521 of the coupling extension 52 and engages with the cross bar 522 in order to cause a pull force on the coupling extension 52 resp. storage container 14. Further, after the rotational movement of the gripper 50, a loaded energy storage 51 (see FIG. 14*a*, 14*b*) is released and the gripper 50 moves into a snapped-over position by unloading of the energy storage 51. Thereby, the coupling engagement 52 resp. the storage container 14 is moved in the depth direction up to the driving unit 21 so that a front wall 15 of the outer housing 16 arranged at the storage container 14 is pressed to a front frame 18 of the ice maker and a locking position of the storage container is set. In the snapped-over position of the closing aid resp. locked position of the storage container 14, the front wall 15 or at least the seal 19 resp. gasket is in contact with front frame 18 of the ice maker 12 and no gap D remains between the rear wall 20 (see FIG. 11) of the front wall 15 and the front frame 18. Thereby the front wall 15 is pressed with a defined pressing force to the front frame 18 or pulled towards the rear and a corresponding pressing force is generated between these components. Preferably, the front frame 18 and the front wall 15 are pressed tightly together and the seal 19 resp. gasket is compressed in between in order to realize a proper sealing of the ice maker 12 to the ambient air. Since the closing aid 48 is arranged at the driving unit 21, which is provided at the rear of the ice maker 20, the front wall 15 is free from any closing mechanisms of the ice maker. Further, the heat insulation provided in the front wall 15 for thermally insulating the ice maker 12 or ice compartment 12*a* from the ambient is not weakened by any assembly space for mechanical components of a closing mechanism. Moreover, the customer is not forced to actuate any buttons or switches to release the front wall 15 or storage container 14 from the ice maker 12.

It will be understood that the manner of arranging the coupling extension 52 and the closing aid 48 can also be reversed if desired, that is to say the coupling extension 52 can be arranged at the drive unit 21, while the closing aid 12 with the components accommodated therein can be mounted at the rear wall of the storage container 14.

FIG. 13*a* shows a perspective view of an embodiment of a closing aid 48 with housing 481 in a basic position. The housing 481 of the closing aid has an insertion opening 49. The insertion opening 49 is provided at a front wall 24 of the driving unit 21 resp. drive housing 22 facing a storage container 14 in the mounted state of the storage container 14 in the ice maker 12. A gripper portion 509 of the gripper 50 comprise two jaws 501, 502 (see FIG. 14*a*, 14*b*). In the basic position of the closing aid 48, the gripping portion 519 is open towards the insertion opening 49 (see FIG. 12*a*, 12*b*), so that the coupling extension 52 (see FIG. 11, 12*a*, 12*b*) can be inserted into the gripping portion 509. In the basic position of the gripper 50, a curved part 506 of the gripper 50 is in contact with a blocking wall 483 formed by the housing 481. The housing 481 comprises at least one shaft guiding groove 501, especially two shaft guiding grooves 501 at opposite sides of the housing 481, into which the supporting shaft 503 is accommodated. The supporting shaft 503 is part of the gripper 50 and the guiding groove 501 defines a translational or linear movement of the gripper 50 and allows rotatable movement of the gripper 50. Accordingly, the supporting shaft 503 is clockwise/counter-clockwise rotatable (with respect to the viewpoint of a sectional view along the longitudinal direction of the housing 481) in this guiding groove 501 and linearly movable in longitudinal direction of the housing 481 resp. linearly movable from the insertion opening 49 to an opposite side of the housing 481 and vice versa.

FIG. 13*b* is a schematic and perspective view of the closing aid 48 with a housing 481 in a snapped-over position. In contrast to FIG. 13*a*, the shaft 503 is moved along the guiding formation resp. the shaft guiding groove 501 into to the rear of the closing aid 48 resp. away from the insertion opening and is now provided farther away from the insertion opening 49. In the snapped-over position of the gripper 50, the jaw 501 of the gripper 50 is in contact with the blocking wall 483. In the snapped over position of the gripper 50, the gripping portion 519 faces away from the insertion opening 49 (see FIG. 12*a*, 12*b*) and a pulling of any coupling extension 52 provided at a storage container 14 further into the housing 481 is effected In FIG. 14*a* is schematically shown a perspective view of the closing aid 48 according to FIG. 13*a* without the housing 481. The closing aid 48 comprises the gripper 50 positioned inside the closing aid 48 resp. housing 481. The closing aid 48 comprises a loaded energy storage 51 respectively tensioned springs 51*a*, 51*b* in the basic position resp. unlocked or open position of the closing aid 48. The energy storage 51 is arranged in the interior of the closing aid 48. By the energy storage 51 a pull force of the gripper 50 is achievable, when the loaded energy storage is changed from the loaded state to the unloaded state. This is effected by the fact that in case of an insertion of a coupling extension 52 (FIG. 11), which is arranged on a rear wall 53 (FIG. 11) of the storage container 14 and projects relative to the rear wall 53 towards the rear into the insertion opening 49, the coupling extension 52 contacts a first jaw 501 of the gripper 50 in the basic position or unlocked position. By a further pushing of the storage container 14 towards the rear, the gripper 50 is turned towards the rear and thereby the energy storage 51 is released. The gripper 50 during this contacting of the first jaw 501 by a coupling extension 52, to start with, performs a rotary movement about an axis of rotation formed by a supporting shaft 513. After the rotary movement of the gripper 50 and no longer contacting of a vertical wall surface 484 of a blocking wall 483 by a curved surface 5061 of a curved part 506 of the gripper 50, the loaded energy storage 51 resp. the tensioned springs 51*a*, 51*b* are released and the gripper 50 coupled therewith further performs a linear movement towards the rear of the closing aid 48 resp. the gripper 50 moves farther away from the insertion opening 49. By the operating principle, the gripper 50 is preferably automatically moved linearly towards the rear by the energy storage 51. If a coupling extension 52 of a storage container 15 is coupled to the gripper 50, a pulling movement along of the coupling extension 52 in the depth direction towards the rear is effected (see FIGS. 12*a*, 12*b*).

In detail, the gripper 50 forms the gripping portion 509, into which the coupling extension 52 of the storage container 14 plunges with its front cross bar 522 (see FIGS. 11, 12*a*, 12*b*). The gripping portion 2509 is bounded by two jaws 501, 502 opposite one another. In the basic position of the closing aid 48, the gripping portion 519 is open towards the insertion opening 49 (see FIGS. 12*a*, 12*b*), so that the coupling extension 52 (see FIGS. 11, 12*a*, 12*b*) can travel into the gripping portion 509, striking with its cross-bar 22 against the jaw 511 and thereby imparting a rotary movement about an axis of rotation formed by a shaft 513. In the course of this rotary movement, the other jaw 512 plunges into the cut-out 521 of the coupling extension 52, so that the cross bar 522 is thereby caught in the gripping portion 519 of the gripper 50 (see FIGS. 11, 12*a*, 12*b*).

In detail, the energy storage 51 comprises the springs 51*a*, 51*b* which are accommodated in the closing aid 48. These springs 51*a*, 51*b* are tensioned in the basic position of the closing aid 48, i.e. when the storage container 15 is released, and relaxed in the snapped-over position of the gripper 50, i.e. when the storage container is locked, and thereby is caused a pull movement on a coupling extension 52 of the gripper 50, by which the gripper 50 is pushed deeper into the housing 481 resp. away from the insertion opening 49 (see FIG. 13*a*, 13*b*). Simultaneously with this pull movement of the gripper 50, a storage container 14 is pulled into the closed end position resp. locked position, which is comfortable for the user, since the forces required to compress an optionally present door seal do not have to be produced completely by the user, but are at least partly provided by the closing aid 48 resp. by the first 514 and second spring 515. The first spring 514 and second spring 515 is formed as a helical compression springs.

In detail, the supporting shaft 503 is formed separately from the gripper 50 and is inserted through an opening 507 of the gripper 50. The supporting shaft 513 is connected in a rotationally fixed manner to the gripper 50, for example, by form fit or friction fit. Of course, it is not beyond the scope of the invention to design the supporting shaft 503 otherwise.

In detail, the longitudinal axis of the springs 51*a*, 51*b* runs substantially parallel to the insertion direction of the coupling extension 52. In the basic position of the closing aid 48, the tensioned springs 51*a*, 51*b* push the gripper 24 into engagement with a blocking wall 483. The blocking wall 483 is formed in this case by a part of the housing 481. In the basic position, the gripper 50 is supported on a vertical wall 484 of this blocking wall 483 via a curved surface 5061 of a curved part 506 of the gripper 50. The curved surface 5061 is designed approximately in the form of a circular arc and allows a rotary movement of the gripper 50 about the axis of rotation defined by the supporting shaft 503. Such a rotary movement of the gripper 50 takes place as mentioned upon inserting of the coupling extension 52 as soon as the coupling extension 52 strikes with its front cross bar 522 the first jaw 501 and thereby sets the gripper 50 in rotation. Upon this rotation, the curved surface 5061 slides along the vertical wall 484 until an edge between the vertical wall 484 and a horizontal wall 485 of the blocking wall 483 is passed. This allows the springs 51*a*, 51*b* to relax and the gripper 50 slides under the action of the relaxing springs 51*a*, 51*b* substantially in longitudinal direction of the closing aid 48 farther away from the insertion opening 14 along the horizontal wall 485 of the blocking wall 483 (see FIG. 11, 13*a*, 13*b*). Since at this stage the coupling extension 52 of the storage container 14 is caught in the gripping portion 509 resp. between the first jaw 501 and second jaw 502, the coupling extension 52 and therewith the storage container 14 with the front wall 15 is drawn by the second jaw 502 along upon this pulling movement of the gripper 50. The front wall 15 of the ice maker 20 is thus closed tightly.

In detail, the springs 51*a*, 51*b* can be seated in the guiding shafts supported at one of their spring ends on the housing 481. At their other spring end, they are supported directly of the supporting shaft 503. The springs 15*a*, 15*b* are arranged such that their spring axes intersect the respective supporting shaft 503.

In FIG. 14*b* is schematically shown a perspective view of the closing aid 48 without housing 481 in a snapped-over position. In contrast to FIG. 14*a*, the gripper 50 rest in the snapped-over position resp. locked position. In this state, the grapping portion 509 of the gripper 50 faces away from an insertion opening 49 of a housing 481 (see FIG. 13*a*, 13*b*) the first jaw 501 is in contact with the vertical wall of the blocking wall 483. Further, a flat surface 5062 of the curved part 506 of the gripper 50 is in contact with the horizontal surface 485 of the blocking wall 483. Further, in this state, the energy storage 51 is unloaded resp. the first spring 51*a* and the second spring 52*b* are relaxed or almost relaxed and still pressing the gripper 50, especially the first jaw 501, against the vertical wall 484. The gripper 24 thereby is supported on the blocking element 44.

To unlock or to bring the gripper 50 back into the basic position, the user need to pull on a front wall 15 resp. front cover of the ice maker 12 or storage container 14. This produces a force on the gripper 50 opposite to the direction of the pull movement, or linear movement away from an insertion opening 49, of the gripper 50. The gripper 50 then moves, under over-increasing tension of the springs 15*a*, 15*b* in the direction towards the insertion opening 49 until the curved surface 5061 of the curved part 506 of the gripper 50 can rotate back in front of the vertical surface 4831 of the blocking wall 483. This reverse rotation of the gripper 50 can be assisted, for example, by a further pretensioned spring (not shown) which is arranged orthogonally to the longitudinal axis of the springs 51*a*, 51*b*. An projection 508 is provided on the curved part 506 of the gripper 50 in order to limit the reverse rotation of the gripper 50.

In an embodiment, the first receiving duct and the second receiving duct viewed in the width direction of the driving unit are arranged offset relative to each other.

In an embodiment, the ice maker comprises an outer housing with a front wall, wherein the front wall is arranged at the front of the storage container and this front wall wherein said front wall upon pulling automatically towards the rear of the storage container is capable of being pulled along towards the rear.

In an embodiment, the ice maker comprises an outer housing with a front frame, wherein in the locking position the front wall is pressed to the front frame.

In an embodiment, on a rear side of the front wall a sealing is arranged.

In an embodiment, the closing aid comprises a gripper and an loaded energy storage for snapping the gripper over from a basic position into a snapped-over position, wherein upon inserting the coupling extension into the insertion opening the gripper is rotated and thereby the loaded energy storage is released so that the gripper is translatorily movable into the snapped-over position by the loaded energy storage automatically and the coupling extension coupled with the gripper is automatically pulled towards the rear and the locking position of the storage container is set.

In an embodiment, the driving unit comprises a drive motor, which is arranged in the drive housing, at least one drive motor arranged in a chamber of the drive housing, a first receiving duct for accommodating a first fastening part extending completely through the drive housing, wherein the drive housing can be fastened by the first fastening part to an inner liner wall of the refrigeration compartment, wherein:

the first receiving duct extends across the entire depth of the drive housing and is open at a front end and is open at a rear end; and a second receiving duct for a second fastening part extends completely through the drive housing, wherein the drive housing can be fastened by the second fastening part to the same inner liner wall of the refrigeration compartment, and wherein said second receiving duct extends across the entire depth of the drive housing and is open at a front end and is open at a rear end.

In an embodiment, the drive housing of the driving unit comprises a front wall and in the drive housing an air duct is formed, wherein an air duct outlet of the air duct is arranged on the front wall.

In an embodiment, the drive housing comprises a front wall, and the driving unit comprises a coupling guide for mechanical coupling of a storage container of the ice compartment with the driving unit, wherein the coupling guide is arranged at the front wall.

In an embodiment, the drive housing comprises a front wall, and in the drive housing a drive motor is arranged, wherein at the front wall a passage is formed, through which a shaft of the drive motor extends or through which a counter-coupling part of a conveyer of the ice compartment can extend in order to couple with the drive motor in the interior of the drive housing.

In an embodiment, a method for locking of an ice maker comprising the following steps: providing a driving unit of the icemaker; providing a storage container of the ice maker; inserting the storage container into an outer housing of the ice maker in the depth direction of the ice maker; inserting a coupling extension, which is arranged on a rear wall of the storage container, into an insertion opening of a closing aid of the ice maker, wherein the insertion opening is formed in a front wall of the drive housing of the driving unit and the closing aid is arranged in the drive housing of the driving unit; coupling the coupling extension with a gripper of the closing aid upon further inserting in the depth direction; triggering a loaded energy storage of the closing aid after predetermined rotating movement of the gripper by further inserting of the storage container in the depth direction; moving the gripper in translation into a snapped-over position by the loaded energy storage of the gripper and thereby pulling of the storage container automatically in the depth direction up to the driving unit so that a front wall of the outer housing of the ice maker arranged at the storage container is pressed to a front frame of the ice maker and a locking position of the storage container is set.

The following is a list of reference numerals used in the above description of the invention with reference to the drawing figures:

| | |
|---|---|
| 1 | household cooling appliance |
| 2 | outer housing |
| 3 | refrigeration compartment |
| 4 | freezer compartment |
| 5 | door |
| 6 | door |
| 7 | door |
| 8 | module |
| 9 | output |
| 10 | dispenser |
| 11 | ice chute |
| 12 | ice maker |
| 12a | ice compartment |
| 13 | ice producer |
| 14 | storage container |
| 14a | outer side |
| 15 | front wall |
| 16 | outer housing |
| 17 | outer housing wall |
| 17a | vertical wall |
| 17b | bottom wall |

-continued

| | |
|---|---|
| 18 | front frame |
| 18a | opening |
| 19 | seal |
| 20 | rear side |
| 21 | driving unit |
| 22 | drive housing |
| 23 | fan |
| 24 | front wall |
| 25 | roof wall |
| 26 | bottom wall |
| 27 | side wall |
| 28 | side wall |
| 29 | receiving duct |
| 29a | rear end portion |
| 29b | front portion |
| 30 | entry |
| 31 | exit |
| 32 | receiving duct |
| 33 | entry |
| 34 | exit |
| 35 | bounding walls |
| 36 | bounding walls |
| 37 | throat |
| 38 | throat |
| 39 | corner portion |
| 40 | edge portion |
| 41 | corner portion |
| 42 | corner portion |
| 43 | air duct |
| 44 | air duct outlet |
| 45 | passage |
| 46 | shaft |
| 47 | coupling entry |
| 48 | closing aid |
| 481 | housing |
| 482 | shaft movement guide |
| 483 | blocking wall |
| 484 | vertical wall surface |
| 485 | horizontal wall surface |
| 49 | insertion opening |
| 50 | gripper |
| 501 | first jaw |
| 502 | second jaw |
| 503 | shaft |
| 506 | curved part |
| 5061 | curved surface |
| 5062 | plane surface |
| 507 | opening |
| 508 | protrusion |
| 509 | gripping portion |
| 51 | energy storage |
| 51a | first spring |
| 51b | second spring |
| 52 | coupling extension |
| 521 | cut-out |
| 522 | cross bar |
| 53 | rear wall |
| 54 | cable channel |
| 55 | coupling entry |
| 56 | coupling entry |
| 57 | ceiling wall |
| 58 | rear wall |
| 59 | inner liner |
| 60 | reinforcement part |
| 61 | reinforcement part |
| 62 | coupling element |
| 63 | coupling element |
| 64 | drive motor |
| 65 | opening |
| 66 | air guiding duct |
| 66a | front end |
| 66b | rear end |
| 67 | duct wall |
| 68 | duct wall |
| 69 | opening |
| 70 | opening |
| 71 | opening |
| 72 | bottom wall |
| 73 | flange |

-continued

| | |
|---|---|
| 74 | part |
| 75 | part |
| 76 | part |
| 77 | component |
| 78 | opening |
| 78' | opening |
| 79 | conveyor |
| 80 | counter coupler |
| 81 | coupling part |
| 82 | crusher unit |
| A | longitudinal axis |
| B | longitudinal axis |
| L | air stream |
| D | gap |

The invention claimed is:

1. An ice maker for mounting into a household cooling appliance, comprising:

a storage container for ice having a rear wall and an opening that is accessible from above;

a coupling extension arranged on said rear wall and extending towards a rear viewed in a depth direction of the ice maker;

a driving unit having a drive housing and a closing aid arranged in said drive housing for locking said storage container in a closed end position;

said drive housing having a drive housing front wall at which an insertion opening of said closing aid is arranged so that, upon an insertion of said coupling extension into said insertion opening, said coupling extension couples with said closing aid and said coupling extension is pulled by said closing aid into a locking position towards the rear viewed in the depth direction of the ice maker.

2. The ice maker according to claim 1, further comprising an outer housing with an outer housing front wall arranged at a front of said storage container, wherein said outer housing front wall, upon pulling towards the rear of said storage container, is capable of being pulled along towards the rear viewed in the depth direction of the ice maker.

3. The ice maker according to claim 2, wherein said outer housing has a front frame and wherein, in the locking position, the outer housing front wall is pressed to the front frame.

4. The ice maker according to claim 2, further comprising a seal disposed on a rear side of said outer housing front wall.

5. The ice maker according to claim 1, wherein said driving unit is arranged at a rear of the ice maker viewed in the depth direction of the ice maker.

6. The ice maker according to claim 1, wherein said closing aid comprises a gripper and an loaded energy storage for snapping said gripper over from a basic position into a snapped-over position, wherein upon inserting said coupling extension into said insertion opening said gripper is rotated and thereby said loaded energy storage is released so that said gripper is translatory movable into the snapped-over position by said loaded energy storage and said coupling extension coupled with said gripper is pulled towards the rear viewed in the depth direction of the ice maker and the locking position of said storage container is set.

7. The ice maker according to claim 1, wherein said drive housing of said driving unit comprises a drive housing front wall and wherein an air duct is formed in said drive housing, said air duct having an air duct outlet arranged on said drive housing front wall.

8. The ice maker according to claim 1, wherein said drive housing comprises a drive housing front wall, and said driving unit comprises a coupling entry for mechanical coupling of said storage container with said driving unit, and wherein said coupling entry is arranged at said drive housing front wall of said drive housing.

9. The ice maker according to claim 1, wherein said drive housing comprises a drive housing front wall and a drive motor is arranged in said drive housing, wherein a passage is formed at said drive housing front wall through which a shaft of said drive motor extends or through which a coupling part of a conveyer of said storage container can extend in order to couple with said drive motor in an interior of said drive housing.

10. A household cooling appliance, comprising:

an ice maker, said ice maker having:

a storage container for ice formed with a rear wall and an opening that is accessible from above;

a coupling extension arranged on said rear wall and extending towards a rear viewed in the depth direction of the ice maker;

a driving unit including a drive housing and a closing aid arranged in said drive housing for locking of said storage container;

wherein said drive housing has a front wall, at which an insertion opening of said closing aid is arranged so that upon insertion of said coupling extension into said insertion opening said coupling extension couples with said closing aid and said coupling extension is pulled into the locking position towards the rear by the closing aid, viewed in a depth direction of said ice maker.

11. A method for locking of an ice maker, the method comprising the following steps:

providing a driving unit of the icemaker;

providing a storage container of the ice maker;

inserting the storage container into an outer housing of the ice maker in a depth direction of the ice maker;

inserting a coupling extension, which is arranged on a rear wall of the storage container, into an insertion opening of a closing aid of the ice maker, wherein the insertion opening is formed in a front wall of a drive housing of the driving unit and the closing aid is arranged in the drive housing of the driving unit;

coupling the coupling extension with a gripper of the closing aid upon further insertion in the depth direction;

rotating the gripper from a basic position by further insertion of the storage container in the depth direction;

releasing a loaded energy storage after a defined rotating movement of the gripper and further translatorily moving the gripper into a snapped-over position by unloading the energy storage and thereby pulling the storage container in the depth direction up to the driving unit so that a front wall of the outer housing of the ice maker arranged at the storage container is pressed to a front frame of the ice maker to thereby set and a locking position of the storage container.

* * * * *